US009579249B2

(12) United States Patent
Fulkerson et al.

(10) Patent No.: US 9,579,249 B2
(45) Date of Patent: Feb. 28, 2017

(54) SAFETY WALKER

(71) Applicants: Michel Fulkerson, Scottsdale, AZ (US); Joshua W. Frank, Sedona, AZ (US)

(72) Inventors: Michel Fulkerson, Scottsdale, AZ (US); Joshua W. Frank, Sedona, AZ (US)

(73) Assignee: SAFETY WALKER LLC, Scottsdale, AZ (US)

( * ) Notice: Subject to any disclaimer, the term of this patent is extended or adjusted under 35 U.S.C. 154(b) by 0 days.

(21) Appl. No.: 15/236,744

(22) Filed: Aug. 15, 2016

(65) Prior Publication Data

US 2016/0374889 A1 Dec. 29, 2016

Related U.S. Application Data

(63) Continuation-in-part of application No. 15/150,297, filed on May 9, 2016, now Pat. No. 9,468,579.

(60) Provisional application No. 62/173,009, filed on Jun. 9, 2015.

(51) Int. Cl.
*A61H 3/04* (2006.01)
*A61H 3/00* (2006.01)

(52) U.S. Cl.
CPC ..... *A61H 3/008* (2013.01); *A61H 3/04* (2013.01); *A61H 2203/0406* (2013.01)

(58) Field of Classification Search
CPC ..... A61H 3/04; A61H 5/027; A61H 5/028; A61H 5/14
USPC ..... 280/87.021; 482/69
See application file for complete search history.

(56) References Cited

U.S. PATENT DOCUMENTS 3,488,088 A * 1/1970 Goldberg ..... A61H 3/04 297/5
3,778,052 A * 12/1973 Andow ..... A61H 3/008 135/67
4,188,966 A * 2/1980 Palmer ..... F16M 13/08 135/67
5,040,556 A 8/1991 Raines
5,058,912 A * 10/1991 Harroun ..... A61H 3/04 135/67
5,083,806 A * 1/1992 Brown ..... A47D 13/043 248/188.5
5,255,697 A * 10/1993 Grauer ..... A61H 3/04 135/67
5,476,432 A * 12/1995 Dickens ..... A61H 3/04 135/67

(Continued)

*Primary Examiner* — Jeffrey J Restifo
(74) *Attorney, Agent, or Firm* — Invention To Patent Services; Alex Hobson

(57) ABSTRACT

A safety walker provides a strap that actuates to allow a person to enter into the safety walker and then raise the strap between their legs. The strap prevents ground level falls. The safety strap is actuated by a strap actuator that may pivot about a pivot attached to the movable support frame. The strap actuator may be locked into a secure position with the strap in an elevated position by a latch. The strap actuator may be coupled to a handle actuator by one or more linkages, or the strap actuator and handle actuator may be a one-piece rigid member that rotates about a single pivot on the moveable frame. A coupling member may extend between a left and right strap actuator proximal to the back end of the strap actuators and the safety strap may be attached to the coupling member.

30 Claims, 25 Drawing Sheets

(56) References Cited

U.S. PATENT DOCUMENTS 5,520,402 A * 5/1996 Nestor ..... A61G 5/00 280/250
6,220,620 B1 * 4/2001 Harroun ..... A61G 5/1059 280/650
6,425,634 B1 * 7/2002 Romero ..... A61G 5/14 297/316
7,568,712 B2 * 8/2009 Kovachi ..... A61H 3/008 280/23.1
8,720,914 B1 * 5/2014 Heath ..... A61H 3/04 135/67
8,968,163 B1 * 3/2015 Vidmar ..... A61H 3/008 482/43
9,180,064 B2 11/2015 Prather
9,278,042 B2 * 3/2016 Osterhaus ..... A61H 3/04
2003/0137119 A1 * 7/2003 Razon ..... A61H 3/008 280/87.021
2004/0002407 A1 * 1/2004 Hawkes ..... A61H 3/008 482/69
2005/0268397 A1 * 12/2005 Nativ ..... A61G 7/1015 5/86.1
2006/0254631 A1 11/2006 Mullholand
2006/0261569 A1 * 11/2006 Delhotal ..... A61G 5/00 280/87.021
2007/0173380 A1 * 7/2007 Gabel ..... A61H 3/008 482/52
2007/0194547 A1 * 8/2007 Steiner ..... A61G 5/14 280/87.021
2009/0242006 A1 10/2009 Warren
2013/0113178 A1 * 5/2013 Goldish ..... A61G 5/14 280/250
2014/0296039 A1 * 10/2014 Shaw ..... A61H 3/04 482/68
2015/0238381 A1 * 8/2015 Swiniarski ..... A61H 3/00 297/5
2015/0272798 A1 * 10/2015 Hsieh ..... A61G 5/14 297/313
2015/0342822 A1 * 12/2015 Osterhaus ..... A61H 3/04 280/657
2016/0051427 A1 * 2/2016 Purwar ..... A61G 7/1046 482/5

* cited by examiner

SAFETY WALKER

CROSS REFERENCE TO RELATED APPLICATIONS

The Application claims the benefit of priority to U.S. patent application Ser. No. 15/150,297 filed on May 9, 2016 and entitled Safety Walker and currently pending, which claims the benefit of U.S. provisional patent application No. 62/173,009 filed on Jun. 9, 2015 and entitled Rehabilitation Safety Walker; the entirety of both are incorporated b reference herein.

BACKGROUND OF THE INVENTION

Field of the Invention

The invention relates to safety walkers and particularly those with a fall restraint.

Background

The elderly and those recuperating from an injury or surgery often require assistance to walk. Some assisted walking devices require complex harness arrangements to prevent ground level falls. Many of these harness and restraint systems require more than one person and thereby limit a person's ability to move about unassisted. Other devices require twisting and/or bending to secure a restraint which is difficult or not possible for many users. Still other assisted walking devices utilize a complete enclosure having a door or gate portion that must be opened for entry, and subsequently shut and secured to ensure the safety of the user. These closures can also be difficult to secure and operate and again may limit a person's unassisted mobility.

There exists a need for a safety walker that is easy to enter, requires no assistance to operate, requires no buckling of harnesses and effectively prevents ground level falls.

SUMMARY OF THE INVENTION

The invention is directed to a safety walker having a safety strap that is easily configured between the user's legs to prevent falling. The safety walker of the present invention incorporates a strap that is coupled to a strap actuator that pivots to lower and raise an actuating end of a safety strap. A user simply has to step into the safety walker, wherein they step over the safety strap as they enter through the back opening, and then actuate the pivoting strap mechanism to raise the back end of the safety strap up into a locked and secure position. The safety strap extends through the user's legs and thereby prevents them from falling while being non-obtrusive as they maneuver the safety walker.

An exemplary safety walker comprises a movable support frame having an opening for easy entry. An exemplary support frame has a base with a plurality of wheels to allow movement of the safety walker in any suitable direction, including forwards, backward, left, right, and rotational movement. An exemplary support frame has a front end, a left side and a right side incorporating support members that are coupled together. An exemplary support frame may have a rounded shape or may be square or rectangular in shape. The left and right sides extend back from the front end to an extended end. The space between the left and right side extended ends creates a back end opening for a user to enter the safety walker. The top support members may act as hand rails for a user to hold onto as they guide the safety walker. The top support members may be at a height suitable for a person, such as an adult person to hold onto while walking. For example, the height of the top support members may be at least about 40 cm, or at least about 50 cm, at least about 70 cm, at least about 90 cm and any range between and including the heights provided. The left and right sides and/or the left and right top support members may be parallel with each other and spaced apart to provide room for a user to enter and maneuver the safety walker. The width between the top left and right support members may be, for example, at least about 40 cm, at least about 50 cm, at least about 60 cm and any range between and including the widths provided. in an exemplary embodiment, the outer width of the safety walker is no more than about 50 cm or no more than about 60 cm to allow the safety walker to fit through doorway openings. The movable support frame may be made out of metal, plastic, composites or any other material that provides enough structural stability to support a user, such as an adult that may weigh about 150 lbs or more, about 200 lbs or more, about 250 lbs or more and even 300 lbs or more.

An exemplary safety walker comprises a pivoting strap mechanism that pivots the back actuating end of the strap up after a user has entered into the safety walker. In an exemplary embodiment, the safety strap is attached to the front end of the moveable support frame and extends back where it is attached to a strap actuator. The entry end of the strap actuator moves up and down to raise and lower the actuating end of the strap. In an entry position, the strap is proximal to the floor, and in a secure position, the strap is raised from the floor and will support a person from falling. The entry end of the strap actuator may be moved by pivoting about a pivot attached to the moveable support frame or by a linkage coupled with a handle actuator. In an exemplary embodiment, a handle actuator and strap actuator are a one-piece rigid member that pivots about a single pivot point. In another exemplary embodiment, the handle actuator is coupled to the strap actuator by a linkage, such as a flexible or rigid linkage. In this embodiment, the handle actuator may rotate about a handle actuator pivot attached to the moveable support frame and a linkage may extend from the handle actuator to the strap actuator, whereby rotation of the handle actuator moves the strap actuator. In a preferred embodiment, the pivoting strap mechanism comprises a strap actuator on opposing sides of the safety walker, a left and a right strap actuator, as described herein. This configuration may provide more rigidity and enable higher loads to be carried by the strap. A back end coupler may extend from a left and right strap actuator at the entry end, or back-end, of the strap actuators. The actuating end of the safety strap may be attached to the back end coupler. Likewise, a left and right strap actuator may comprise a front end coupler that extends between the two strap actuators proximal to the pivot end or handle end. In the entry position, the back end coupler and strap are either touching the floor or are very close to the floor to enable a person to enter and step over them with ease. In the secure position, the entry end of the strap actuator is elevated to where it is locked into the secure position by an actuator lock mechanism, such as a latch. The actuating end of the strap is now elevated off of the floor and will restrain a user in the event of a fall.

As described, in an entry position, the strap and back end coupler of the strap actuator are proximal to the floor to allow easy entry into the safety walker. For example, the safety strap and back end coupler may be no more than 7 cm off the floor, no more than about 5 cm off the floor, no more than about 3 cm of the floor and any range between and including the height off the floor provided. In an exemplary embodiment, the back end coupler is a flat support member that provides enough structural support but is low profile for ease of entry into the safety walker. Likewise, the safety strap may have a thickness that is sufficiently low profile. The safety strap may be a fabric that is woven and may have a width that is sufficient to secure a person during a fall. The width of the strap may be, for example, at least about 4 cm, at least about 5 cm, at least about 7 cm, at least about 10 cm, at least about 15 cm and any range between and including the safety strap widths provided. It is important that the safety strap not be too wide as it may become too obtrusive for a person to walk. The thickness of the safety strap may be less than about 2 cm, less than about 1 cm, less than about 0.5 cm, less than about 0.25 cm and any range between and including the thickness values provided.

As described, in a secure position, the strap actuator is locked into a forward rotation position by an actuator lock mechanism. In an exemplary embodiment, the actuator lock mechanism automatically locks the strap actuator into position. For example, a latch may be deflected by a portion of the strap actuator as it is rotated forward and then secure the strap actuator in position. A latch may secure the strap actuator by gravity or there may be a spring strap actuator mechanism that ensures a firm retention of the strap actuator in a secure position. In an exemplary embodiment, an actuator lock mechanism secures a front end coupler of the strap actuator in position. An exemplary actuator lock mechanism may have a simple actuator release mechanism, such as a lever or bar or handle that is actuated to release the strap actuator from the lock, or latch. In an exemplary embodiment, a actuator release is a handle that is coupled with the actuator lock mechanism and actuating the release enables the strap actuator to rotate back to allow the user to exit from the safety walker. The back end of the strap actuator will drop freely to the floor and the person may simply back out of the safety walker.

An exemplary pivoting strap mechanism may comprise one or more dampers to ensure the back end of the strap actuators, or the back end coupler, does not fall too rapidly to the floor, thereby damaging the floor and/or the safety walker. A damper, comprising a cylinder and piston, for example, may be coupled between the strap actuator and the movable support frame.

In an exemplary embodiment, a safety walker comprises a left and a right trap actuator that are coupled together proximal the front or near the handles by a front end coupler and are coupled together proximal the back end, by a back end coupler. A connected support structure greatly increases the rigidity and load bearing capability of the pivoting strap mechanism. When a left and right strap actuator are incorporated, the back end coupler may be a thinner material to facilitate ease of entry into the safety walker.

In an exemplary embodiment. the safety strap is attached to a support member of the front end of the movable support frame and is attached to the back end coupler. The strap may be attached to these support members by being looped around them, tied to them or otherwise secured. The length of the strap is fixed and extends between the front end support member and the back end coupler. The strap may be loose and droop between these two support members but the length of the strap does not require adjustment, such as tightening or shortening, to provide effective support when a person falls. In an exemplary embodiment, the back end of the safety strap, the actuating end, is simply raised up by rotation of the strap actuator upon entry.

An exemplary safety walker may comprise a wheel lock mechanism to allow a user to lock the wheel whenever desired, or particularly upon entry and/or exit. A wheel lock actuator may be positioned in an ergonomic location to allow easy engagement and disengagement of the wheel lock. A lever may be positioned along one of the sides of the moveable support structure, such as up along a top support member. A user may simply rotate the wheel lock actuator to engage the wheel lock. A cable or other linking mechanism may couple the wheel lock actuator with the wheel lock.

In an exemplary embodiment, a strap actuator system comprises a motor that lifts the actuating end of the strap up through a connection with a strap actuator or pivoting strap mechanism, or through connection of cables or wires with a strap-bar. A strap-bar is a bar that extends across the back end of the movable support frame and has the actuating end of the strap connected thereto. An exemplary motorized strap actuator system may comprise an electric motor that winds up cables that extend from the strap-bar or strap bar assembly to the motor, or portion of a take-up system coupled with the motor. A user interface may be used to initiate the lifting of the strap-bar after entering into the movable support frame. The strap-bar may be guided up along rails, wherein the strap-bar of a portion of the strap-bar assembly engages with the rail to guide the strap-bar up and down. A rail may comprise a protrusion and the strap-bar assembly may extend around a portion of the protrusion, or vice versa. For example, a rail may have a dove-tail protrusion and the strap-bar assembly, or rail coupling may have a dove-tail shaped recess for coupling around the dove-tail shaped protrusion. The strap-bar may have a gear that engages with teeth or a linear gear that extends along the rail to cause the strap-bar to rotate and wind up slack in the strap. The strap may be wound around the strap-bar as it approaches the top of the rail, for example. This enables the movable support frame to have a shorter length and, whereby the strap can be long enough to rest on the floor for entry and then be wound up around the strap-bar to provide adequate fall support, wherein the strap is taught enough between the user's legs. A latch or other suitable type of catch may be configured proximal to the top of the rails to lock the strap-bar in an up or secure position. A strap-bar release lever may be provided to release the latch and allow the strap-bar to lower back down to an entry position, with the strap-bar proximal the floor. The strap-bar release lever may be configured near the front of along the support frame and may be coupled to the latch by a coupling element, such as a wire or cable. In an alternative embodiment, a crank may be provided in place of or in combination with the motor to allow a user to lift the strap-bar by turning the crank, or a user may further tighten the strap by rotating the crank.

In another exemplary embodiment, a motor is configured to pivot or rotate a strap actuator, as described herein. Instead of handles to pivot the strap actuator and raise the back-end coupler and the strap coupled thereto, a motor may be coupled to the strap actuator, directly or through gears, to rotate the strap actuator. In an exemplary embodiment, an electric motor drives a worm gear that couples with a drive gear that is in plane with the strap actuator. In this embodiment, the worm gear rotates orthogonally to the drive gear, thereby making the drive system more compact. Again, a user interface may be provided to initiate the motor and raise the actuating end of the strap. The user interface may have a lever for raising and lowering the strap whereby a user can stop the raising of the strap to a comfortable position for their height. A latch may be configured to lock the strap actuator or the back-end coupler at an elevated and secure position and again a release may be configured to allow a user to release the latch and allow the actuating end of the strap to be lowered back down. A latch and release may ensure that the strap remains in a secure and locked position until the user is ready to exit the safety walker.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of his specification, illustrate embodiments of the invention, and together with the description serve to explain the principles of the invention.

DETAILED DESCRIPTION OF THE ILLUSTRATED EMBODIMENTS

Figure 1:
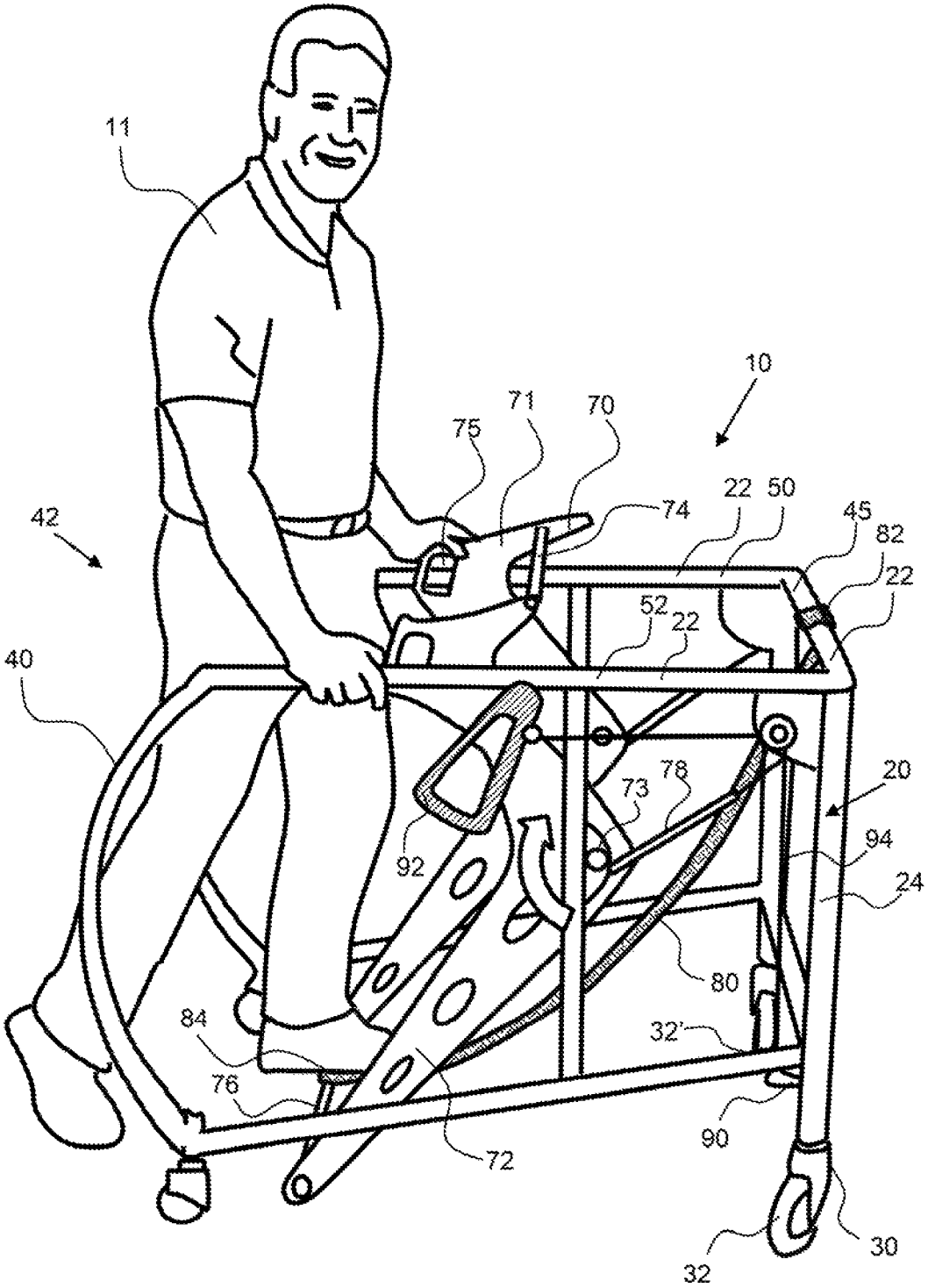
FIG. 1 shows a side view of an exemplary safety walker with a person entering the back end opening and stepping over the back end coupler of the pivoting safety strap mechanism.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale; some features may be exaggerated to show details of particular components. Therefore, specific structural and functional details disclosed herein are not to be interpreted as limiting, but merely as a representative basis for teaching one skilled in the art to variously employ the present invention.

As used, herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

In cases where the present specification and a document incorporated by reference include conflicting and/or inconsistent disclosure, the present specification shall control.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications and improvements are within the scope of the present invention.

DEFINITIONS

As shown in FIG. 1, a person 11 is entering an exemplary safety walker 10 through the back end opening 42 and stepping over the back end coupler 76 of the pivoting safety strap mechanism 70. The person 11 enters and straddles the safety strap 80. The safety walker 10 comprises a movable support frame 20 having a front end 45, left side 50, right side 52 and back end 40. A plurality of frame support members 24 are coupled together to create the moveable support frame 20. The support frame has wheels 32 coupled to the base 30 that enables the support frame to move freely in any direction, as described herein. The top portions of the left and right sides as well as the front end 45 of the support frame provide a hand rail 22 for a person to hold onto and guide the safety walker. There is an opening in the back end to allow a person to easily enter the safety walker. A strap 80 has a length from the fixed end 82, attached to the front end 45, to the actuating end 84, attached to the back end coupler 76 of the pivoting strap mechanism 70. The pivoting strap mechanism has a left strap actuator 71 and a right strap actuator 72 that are rigid members that pivot or rotate about the pivot 73 secured to the movable support frame, as indicated by the large arrow around the pivot 73. The safety strap extends from the front end 45 of the support frame 20 to the back end coupler that extends between the left and right strap actuators proximal the back end of the actuators. As shown, the back end coupler and actuating end of the strap are resting on the floor when the safety walker is in an entry position. The wheel lock actuator 90 is configured to lock the wheels 32 from moving. A cable 94 extends from the wheel lock actuator 92 to engage a break or wheel lock 90 on the wheels, 32, 32'.

Figure 2:
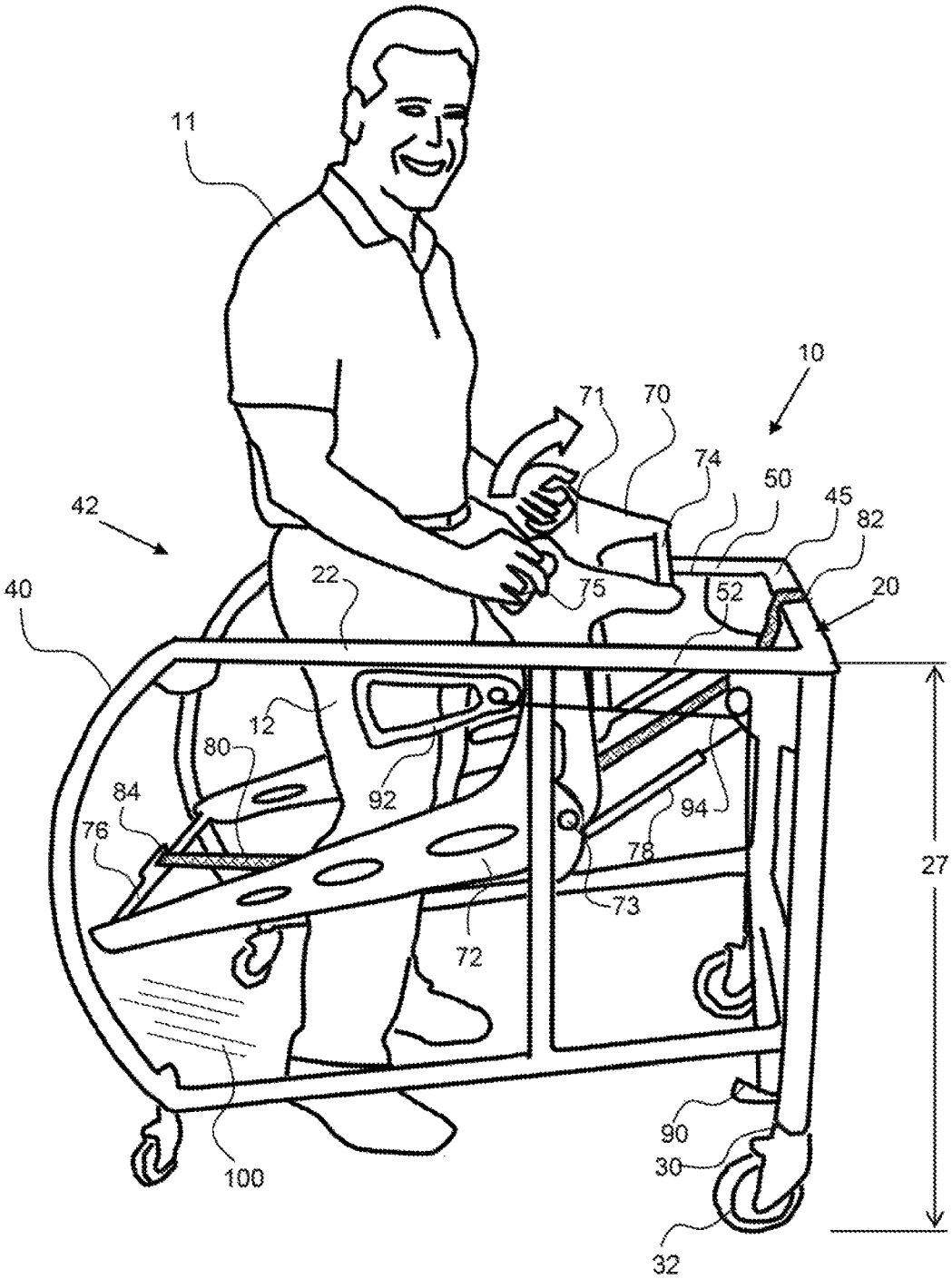
FIG. 2 shows a side view of an exemplary safety walker with a person actuating the pivoting safety strap mechanism forward to raise the actuating end of the safety strap.

As shown in FIG. 2, the person 11 is now within the exemplary safety walker 10 and the strap 80 is extending through the person's legs 12. The pivoting strap mechanism is rotated up from the entry position but is not locked into a secure position. The actuating and 84 of the safety strap 80 as well as the back and coupler 76 are raised off of the floor 100. The left and right strap actuators have handles 75 for the person to hold onto as they pivot the actuators into a secured position, shown in FIG. 3. Dampers 78 are coupled between the left and right strap actuators and the support frame 20 to prevent the strap actuators from dropping and damaging the floor. The height 27 of the safety walker and the height of the top support members or hand rails 22 is suitable for a person to use for assistance as they maneuver the safety walker, as described herein.

Figure 3:
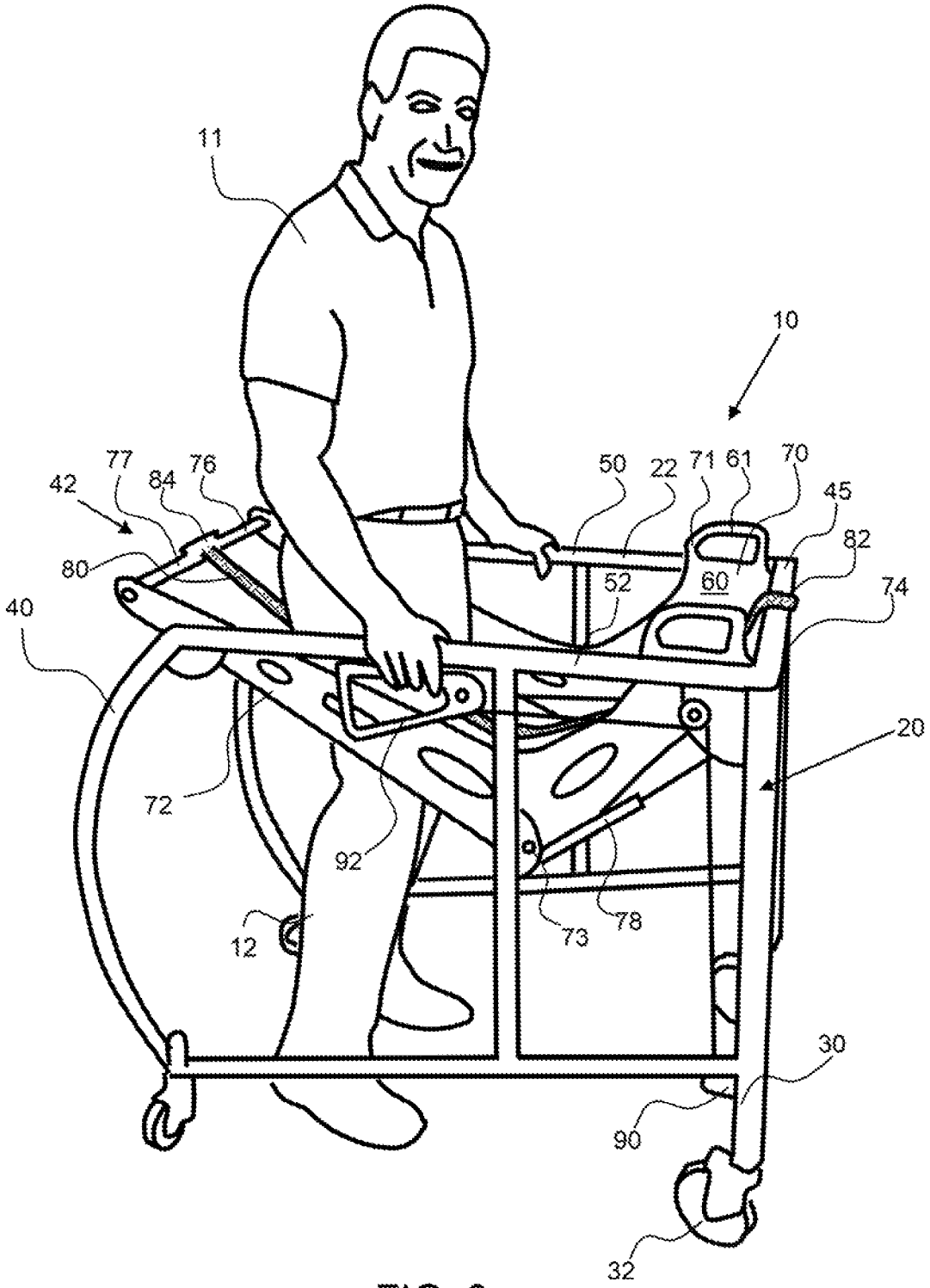
FIG. 3 shows a side view of an exemplary safety walker with a person secured in the safety walker with the pivoting safety strap mechanism locked into a secure position and the safety strap extending from a front end through the person's crotch to the actuating end.

As shown in FIG. 3, the exemplary safety walker 10 is now in a secure position or orientation with the strap actuators 71, 72 pivoted forward until they are locked into position by a latch, not shown. The person can now move the safety walker with the safety strap 80 extending from the front end 45, through their legs 12, to the back end coupler 78 that is now raised off the ground and secured in an elevated position. The wheel lock actuator has been rotated to free the wheel lack and thereby allow free movement of the safety walker.

Figure 4:
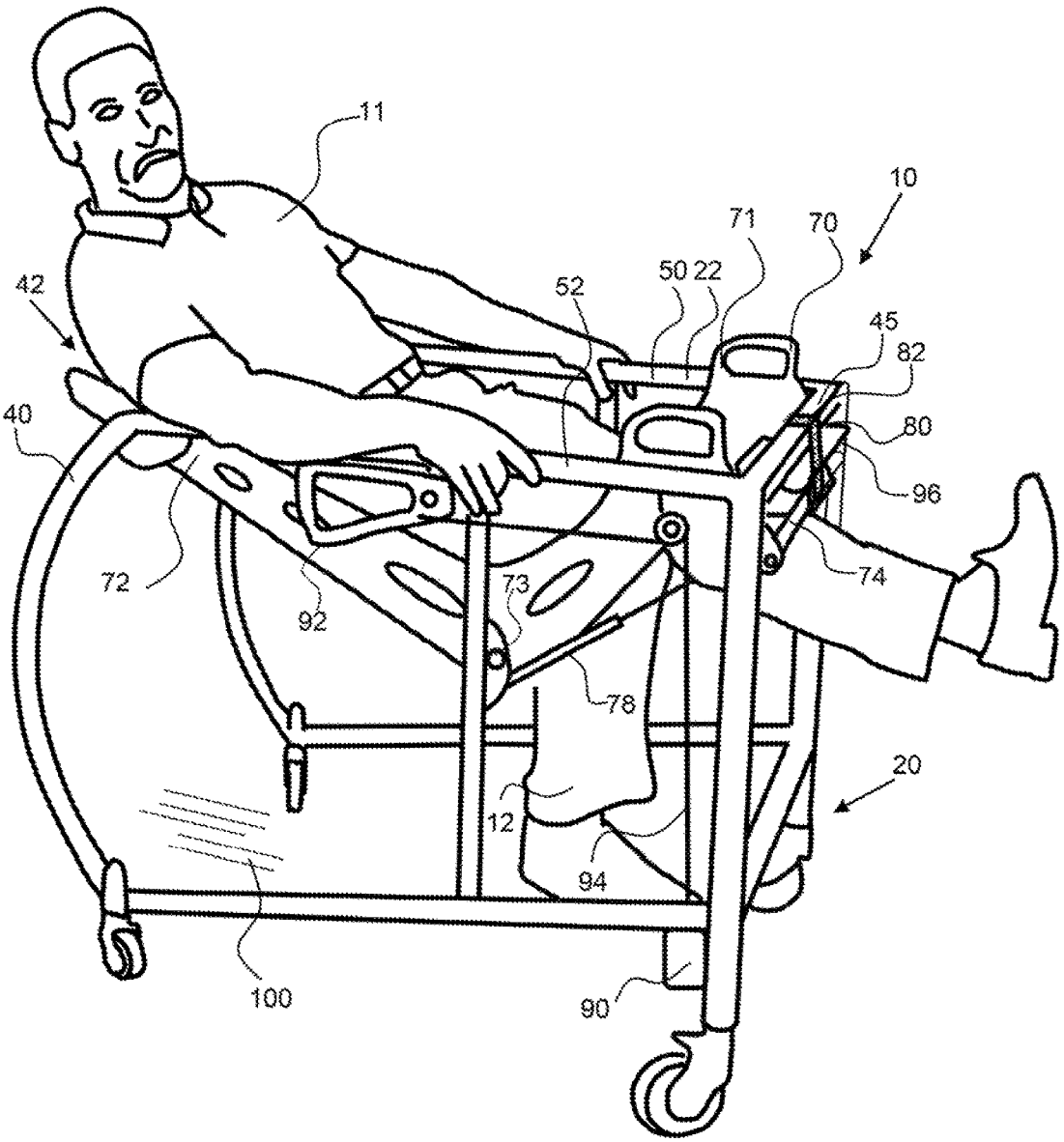
FIG. 4 shows a side view of an exemplary safety walker with a person being secured by the strap after falling.

As shown in FIG. 4, the person 11 has fallen and has been caught by the safety strap extending through their legs 12. The person cannot fall as the strap extends through their crotch and the hand rails 22 prevent them from falling to either side.

Figure 5:
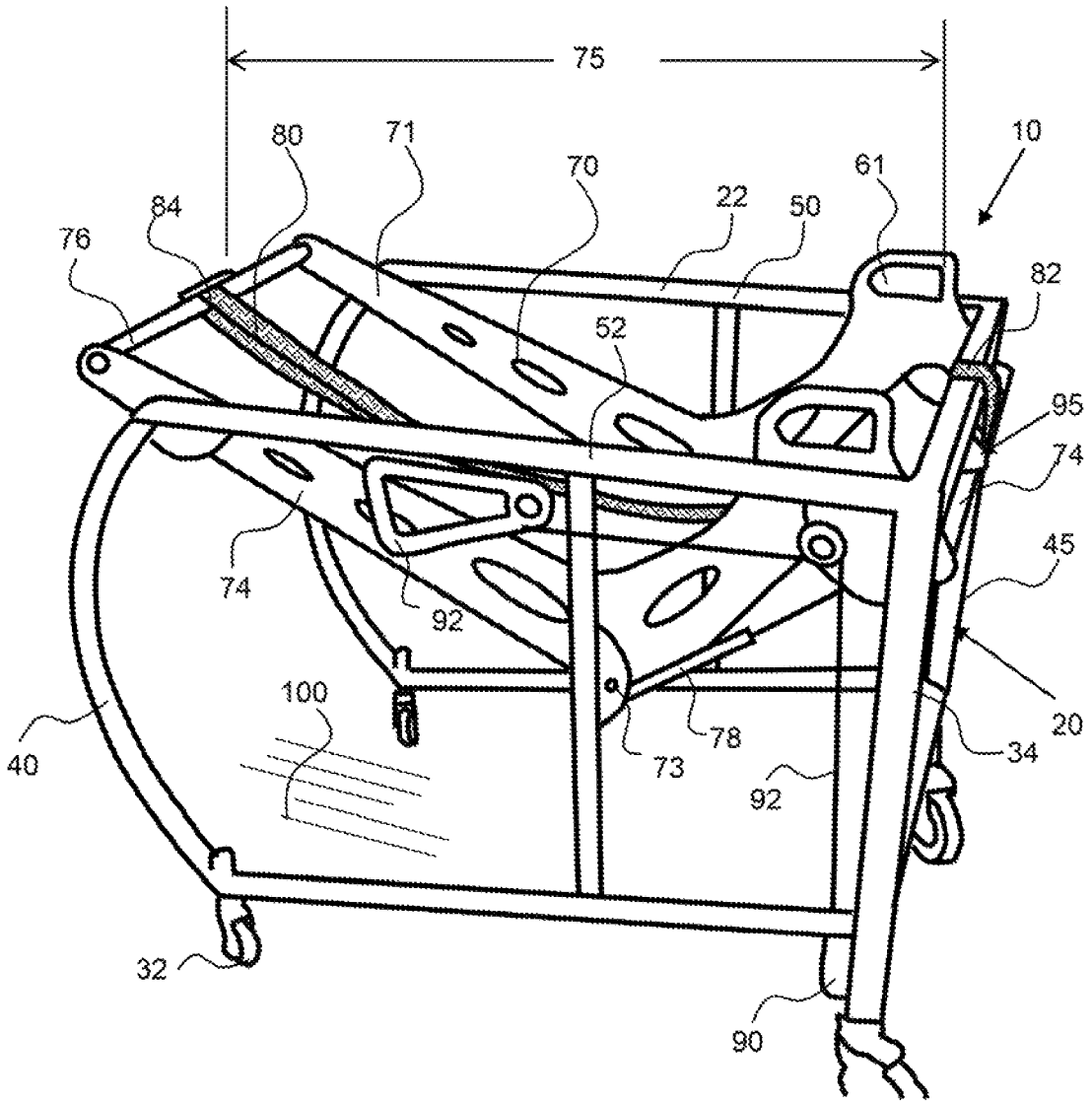
FIG. 5 shows a side view of an exemplary safety walker with the pivoting safety strap mechanism in a secured position.

As shown in FIG. 5, an exemplary safety walker 10 has the pivoting strap mechanism 70 in a secured position. In this exemplary embodiment, the front end coupler 74, a bar extending between the left and right strap actuators, is retained in position by an actuator lock mechanism 95. A latch of the actuator lock mechanism may deflect as the strap actuator is rotated forward to engage with the front end coupler to retain it in position. As shown in FIG. 5, the safety strap 80 is elevated from the floor. The front end 82 is secured to the support frame 20 and the back end, or actuating end 84, is coupled with the back end coupler 76. The length of the strap actuator 75 from the back end coupler to the handle 61 is shown.

Figure 6:
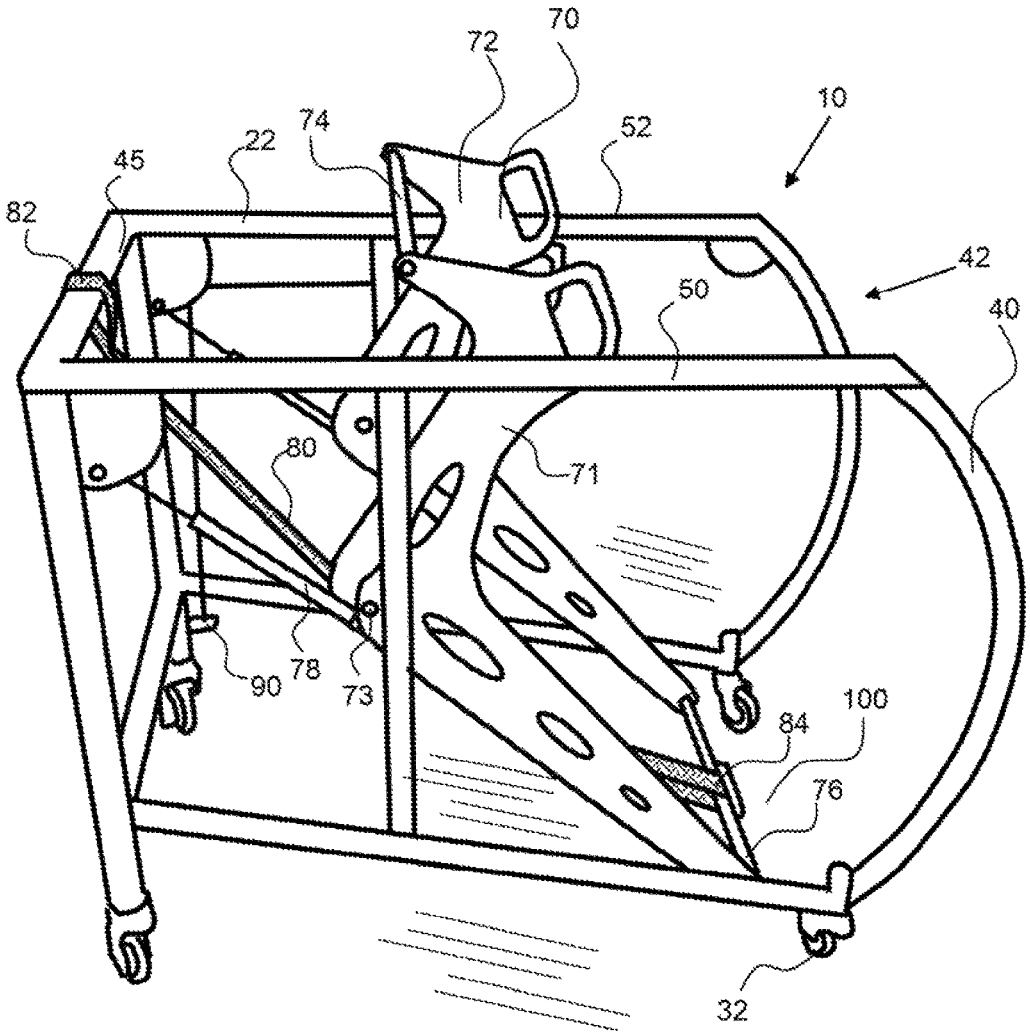
FIG. 6 shows a side view of an exemplary safety walker with the pivoting safety strap mechanism in entry position, wherein the actuating end of the strap and back end coupler are resting on the floor.

As shown in FIG. 6, an exemplary safety walker 10 has the pivoting safety strap mechanism 70 in an entry position, wherein the actuating end 84 of the safety strap 80 and the back end coupler 76 are resting on the floor 100. This allows a person to easily step over the back end coupler and straddle the safety strap 80. The person can then actuate the pivoting safety strap mechanism 70 by rotating it forward and about the pivot 73 until it latches automatically into a secure position. The person can then freely move with the walker in any position by grasping the hand rails 22 and pushing the safety walker 10.

Figure 7:
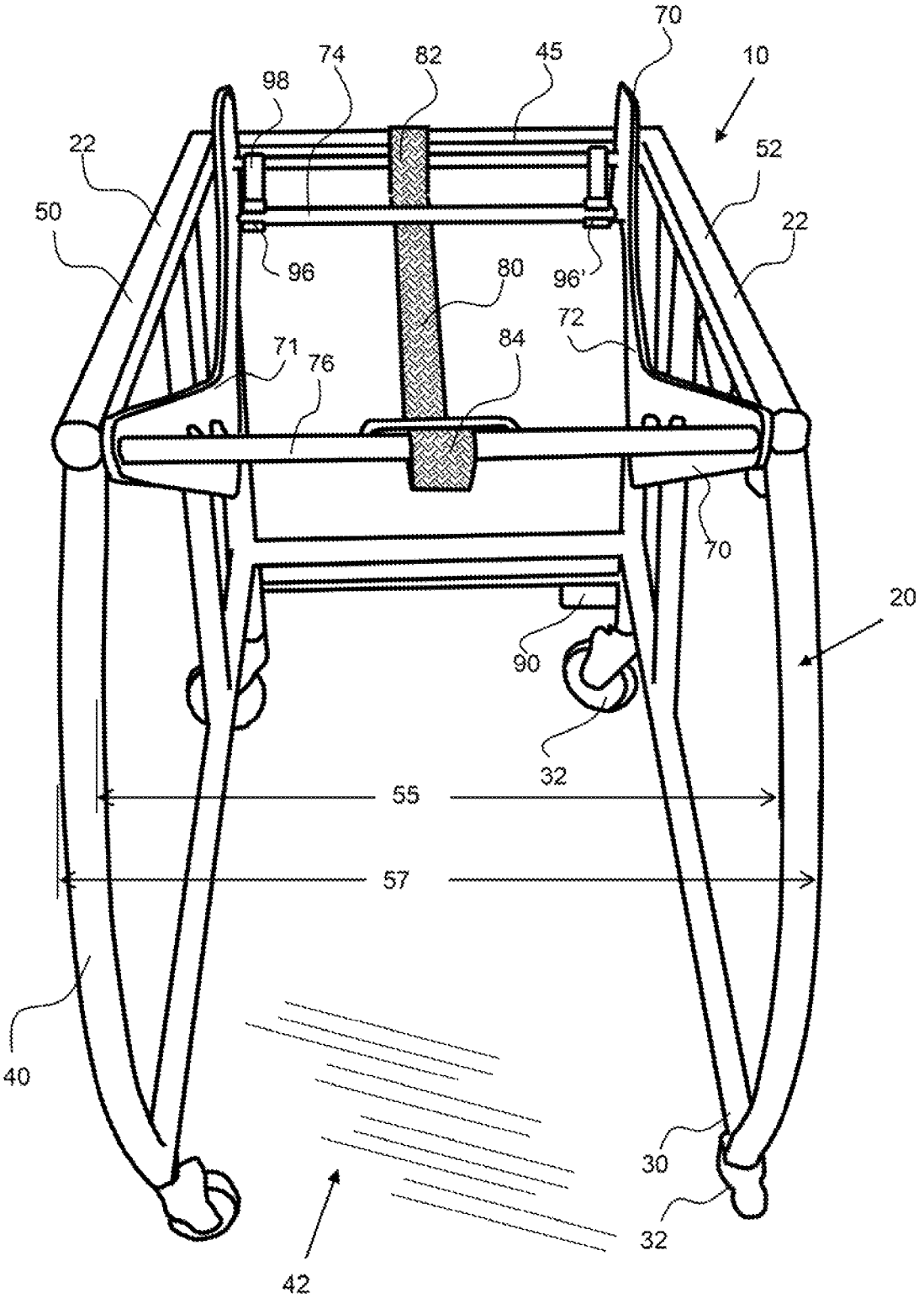
FIG. 7 shows a back end view of an exemplary safety walker with the pivoting safety strap mechanism in a secured position.

As shown in FIG. 7, an exemplary safety walker 10 is in a secure position with the pivoting safety strap mechanism 70 retained in a secured position by the latch 96. The latch has two extensions from a latch actuator 98 that extends around the front end coupler 74 when it is pushed down into the secure position. The latch extensions may be spring loaded or may fall into place to secure the actuator by gravity. The width 55 between the left and right sides, or entry opening width, as well as the outer width 57 of the safety walker, or the movable support frame, are shown.

Figure 8:
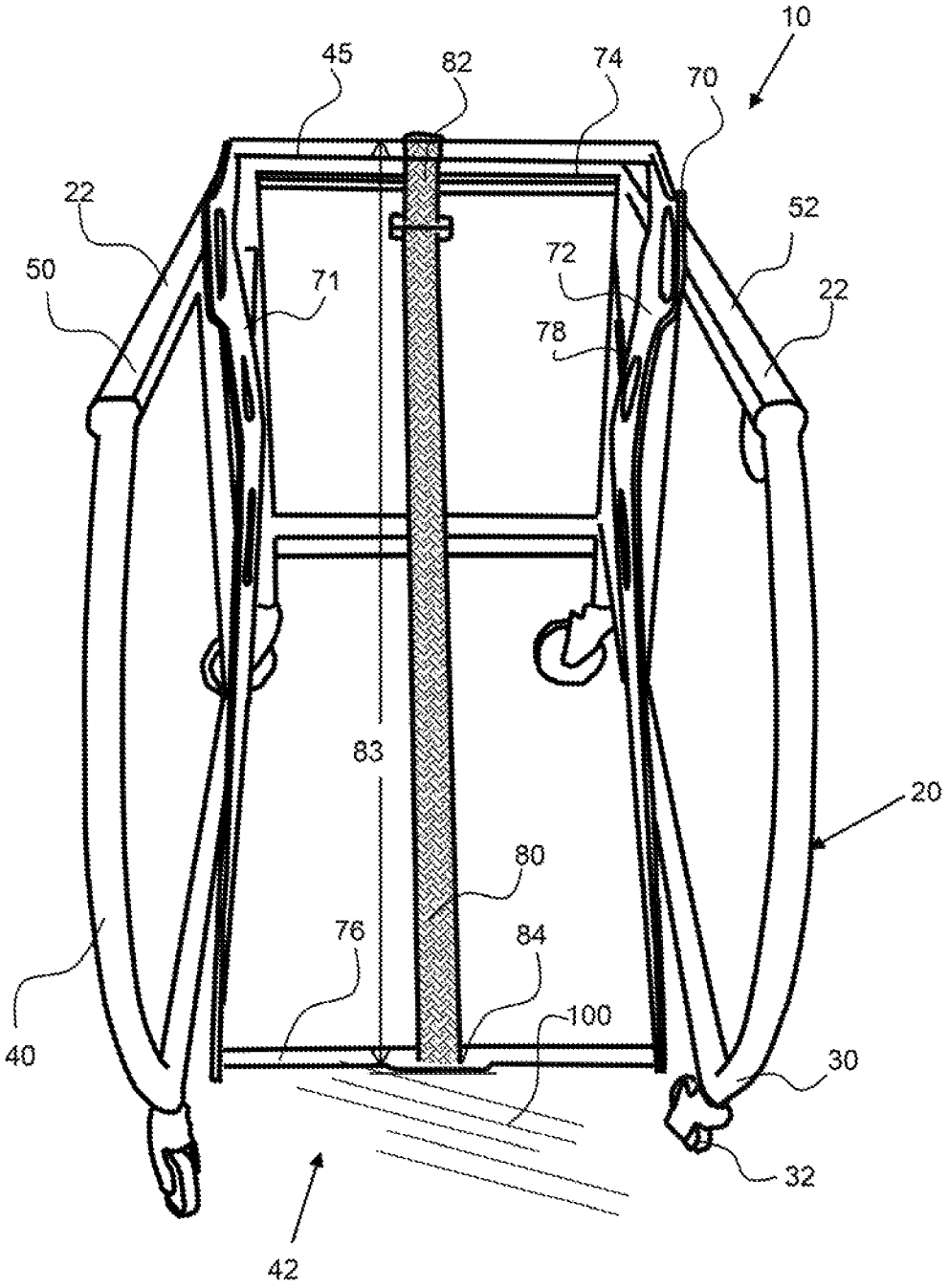
FIG. 8 shows a back end view of an exemplary safety walker with the pivoting safety strap mechanism in entry position, wherein the actuating end of the strap and back end coupler are resting on the floor.

As shown in FIG. 8, an exemplary safety walker 10 is in an entry position with the pivoting safety strap mechanism 70 dropped down. The actuating end of the strap 84 is secured to the back end coupler 76 that is resting on the floor 100. The back end coupler may have a flat profile making it easy for a person to step over the back end coupler and into the safety walker. The length 83 of the safety strap 80 is shown. As described herein, the safety walker may provide effective fall prevention without requiring adjustment of the strap length between the front end 45 and the back end coupler 76.

Figure 9:
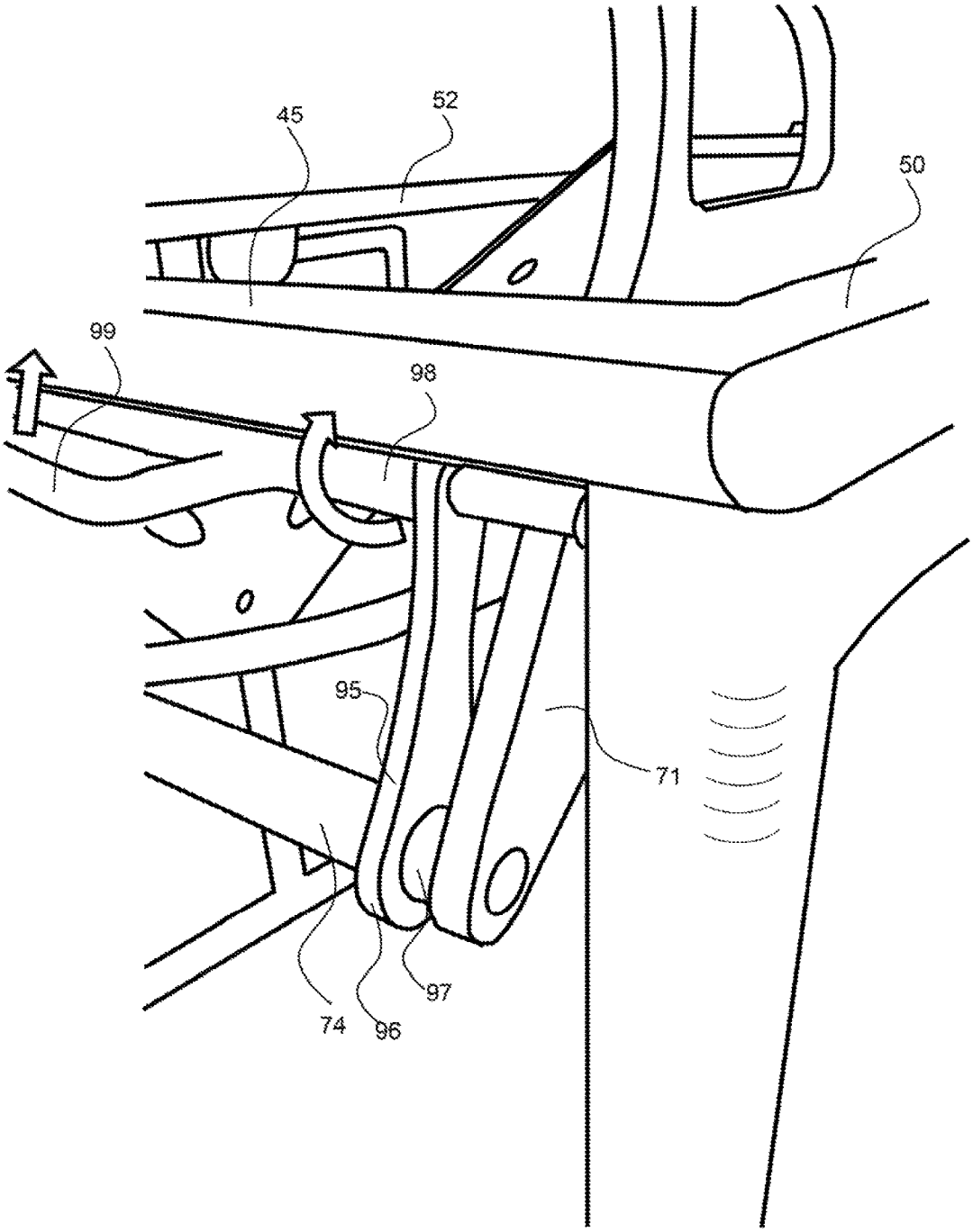
FIG. 9 shows a perspective view of the latch actuator and latch that secures the pivoting strap mechanism in a secure position.
Figure 10:
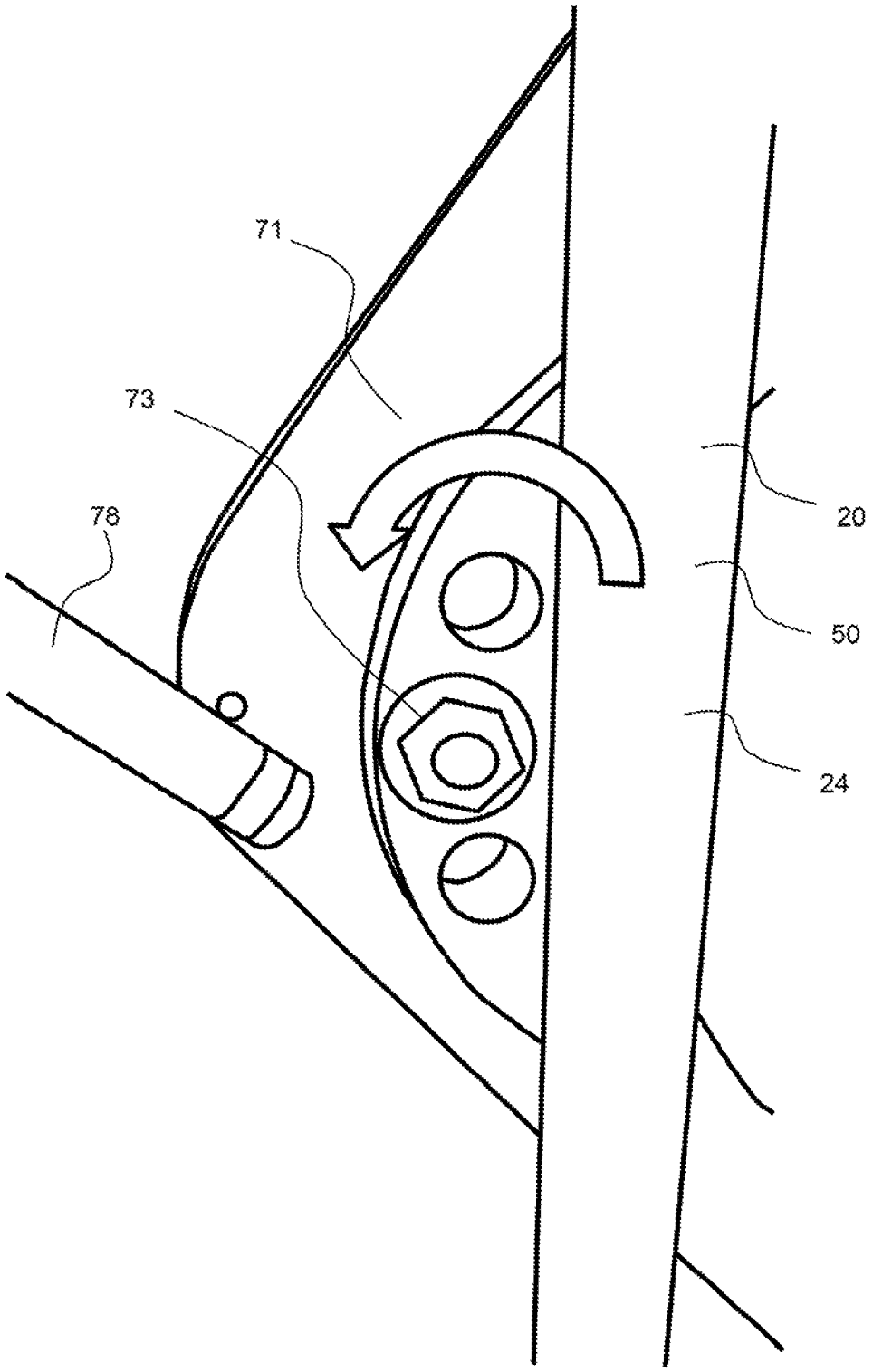
FIG. 10 shows a perspective view of a portion of the left side of the support frame having a pivot that couples with the left strap actuator.

As shown in FIG. 9, an exemplary actuator lock mechanism 95 comprises a latch actuator 98 and latch 96 that secure the front end coupler 74 into a secure position. The front end coupler will hit the latch 96 and deflect it until the opening in the latch 97 seats around the front end coupler 74. A latch actuator 99 allows a person to release the latch by pulling up on the latch actuator which rotates the latch or latches from engagement with the front end coupler.

As shown in FIG, 10, a damper 78 is attached to the left strap actuator 71. The left strap actuator 71 is coupled to the movable support frame 20 on a left side 50 support member 24. The strap actuator 71 is configured to rotate about the pivot 73 forward and backward. Forward rotation to engages the strap actuator lock mechanism and secures the strap actuator in a secure position. Backward rotation positions the actuating end of the strap and the back end coupler proximal to the floor.

Figure 11:
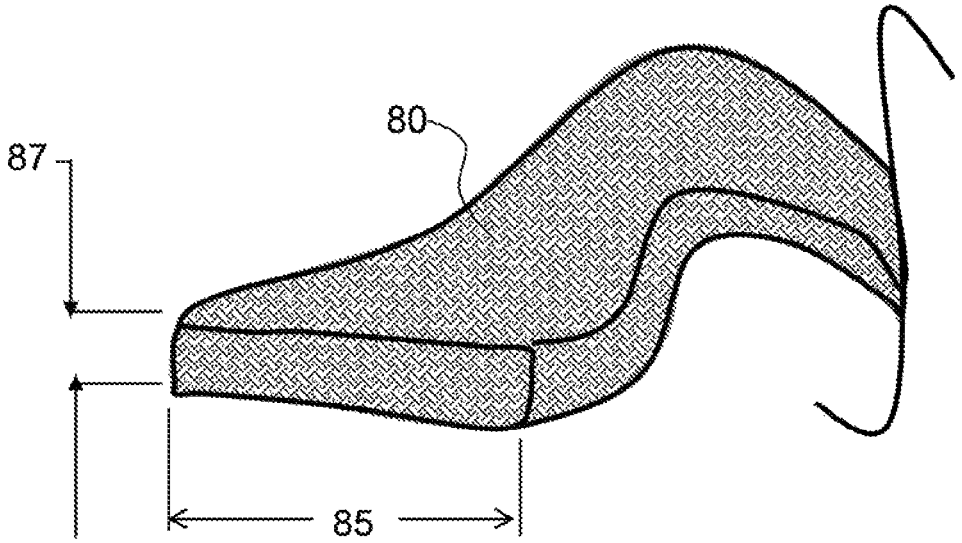
FIG. 11 show s perspective cross section of an exemplary strap.

As shown in FIG. 11, an exemplary strap 80 has a width 85 and thickness 87, as described herein. The width of the strap may be suitably narrow to reduce interference with walking and sufficiently wide enough to secure the person in the event of a fall. As described herein, the thickness of the strap may be sufficiently thin to allow easy entry into the safety walker.

Figure 12:
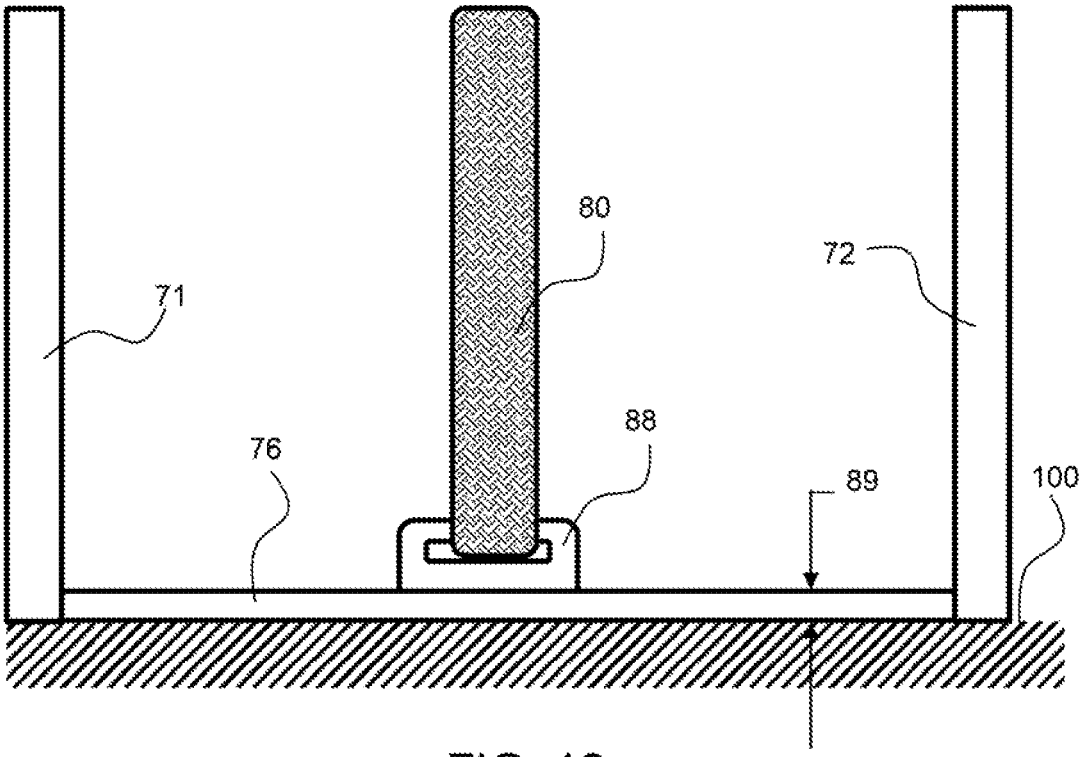
FIG. 12 shows the back view of a portion of the safety walker in an entry position with the back end coupler on the floor.

As shown in FIG. 12, the safety strap 80 may be coupled with an extension portion 88 of the back end coupler 76 to reduce the height of the back end coupler from the floor when in an entry position. The back end coupler may have a thickness 89 that is sufficiently small to allow easy entry into the safety walker.

Figure 13:
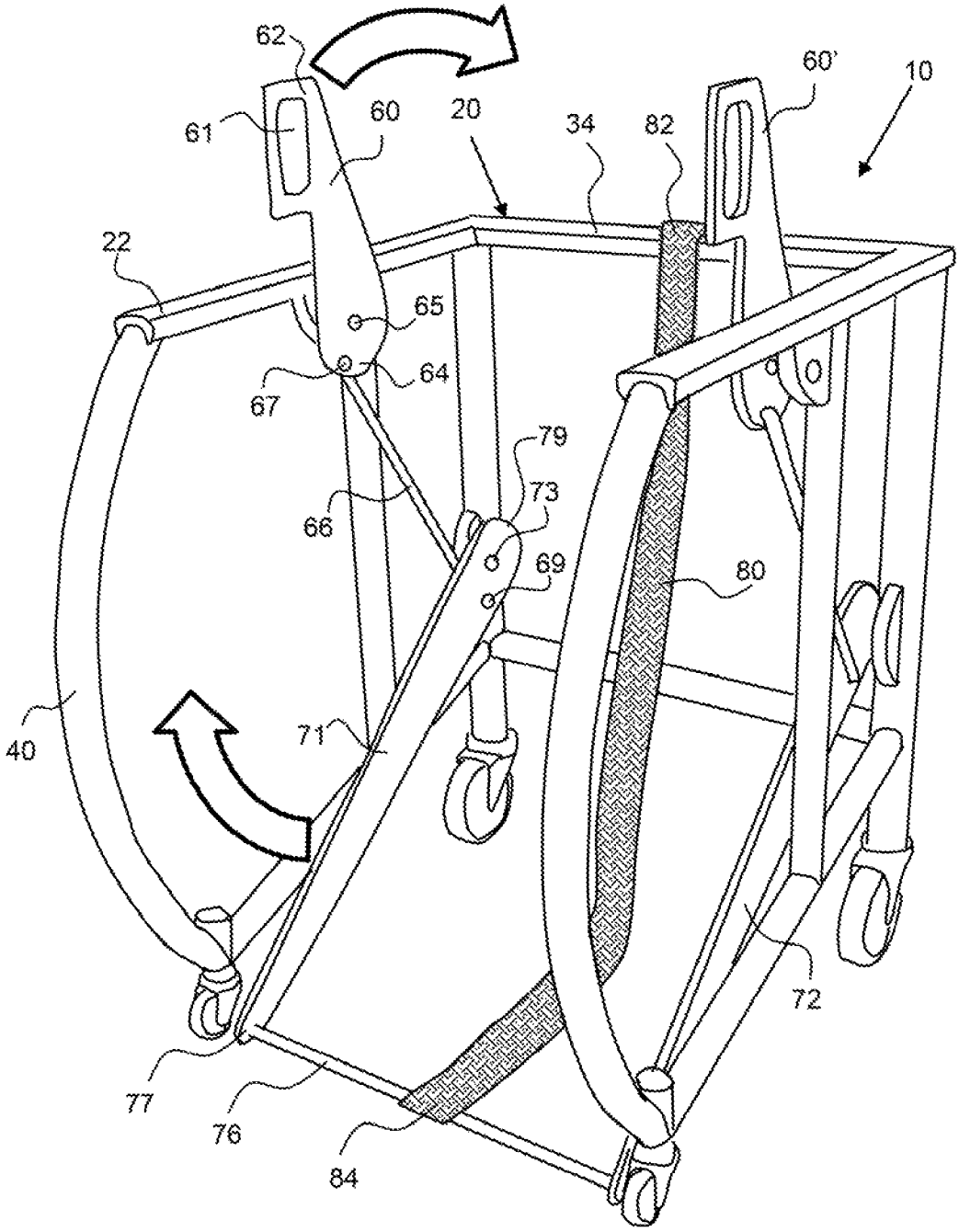
FIG. 13 shows a back-end perspective view of an exemplary safety walker with a handle actuator coupled to a strap actuator by a linkage and the entry end of the strap actuator in a down position, or proximal to the floor.

As shown in FIG. 13, of an exemplary safety walker 10 is configured with a handle actuator 60 coupled to a strap actuator 71 by a linkage 66. The handle actuator 60 has a handle 61, and a length from a handle end to a pivot end 64. The handle actuator pivots Of rotates about the handle actuator pivot 65 and thereby moves the linkage 66. The linkage 66 may be a rigid linkage, such as a rod, or strut, or may be a flexible linkage, such as a cable, or wire, for example. The linkage has a length and extends from the handle-end 67 to the strap-actuator end 69. Actuation of the handle actuator 60 about the handle actuator pivot 65, as indicated by the bold arrow, pulls the strap actuator 71 up through the linkage. The linkage is attached to the handle actuator at an offset distance from the handle actuator pivot and from the strap actuator pivot 73. The strap actuator has a length and extends from the pivot end to the entry end 77. The linkage pulls the strap actuator and causes it to rotate about the strap actuator pivot 73, as indicated by the bold arrow, thereby raising the actuating end of the strap. The strap 80 extends from the front end 34 of the movable support frame 20 to the actuating end 84 that is coupled to the back-end coupler 76. The back-end coupler extends between the left strap actuator 71 and right strap actuator 72.

Figure 14:
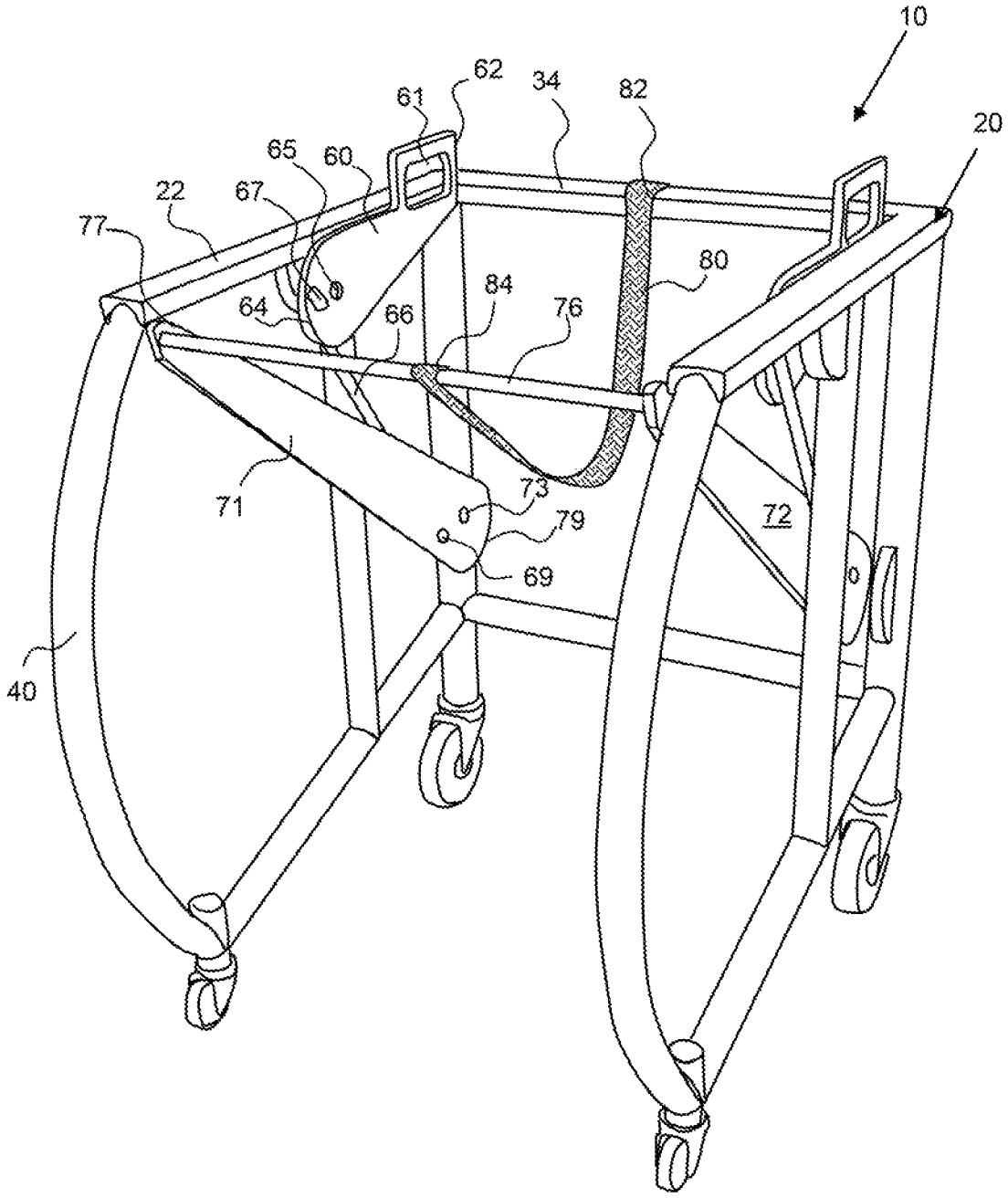
FIG. 14 shows a back-end perspective view of an exemplary safety walker with a handle actuator coupled to a strap actuator by a linkage and the entry end of the strap actuator in an up position, or in a secure position.

As shown in FIG. 14 the exemplary safety walker 10 shown in FIG. 13 is now configured in a secure position, wherein the actuating end 84 of the strap 80 is elevated and locked into place. The handle actuator 60 has been rotated forward toward the front end 34 of the movable frame 20 and is locked into position. This secures the strap actuator in position.

Figure 15:
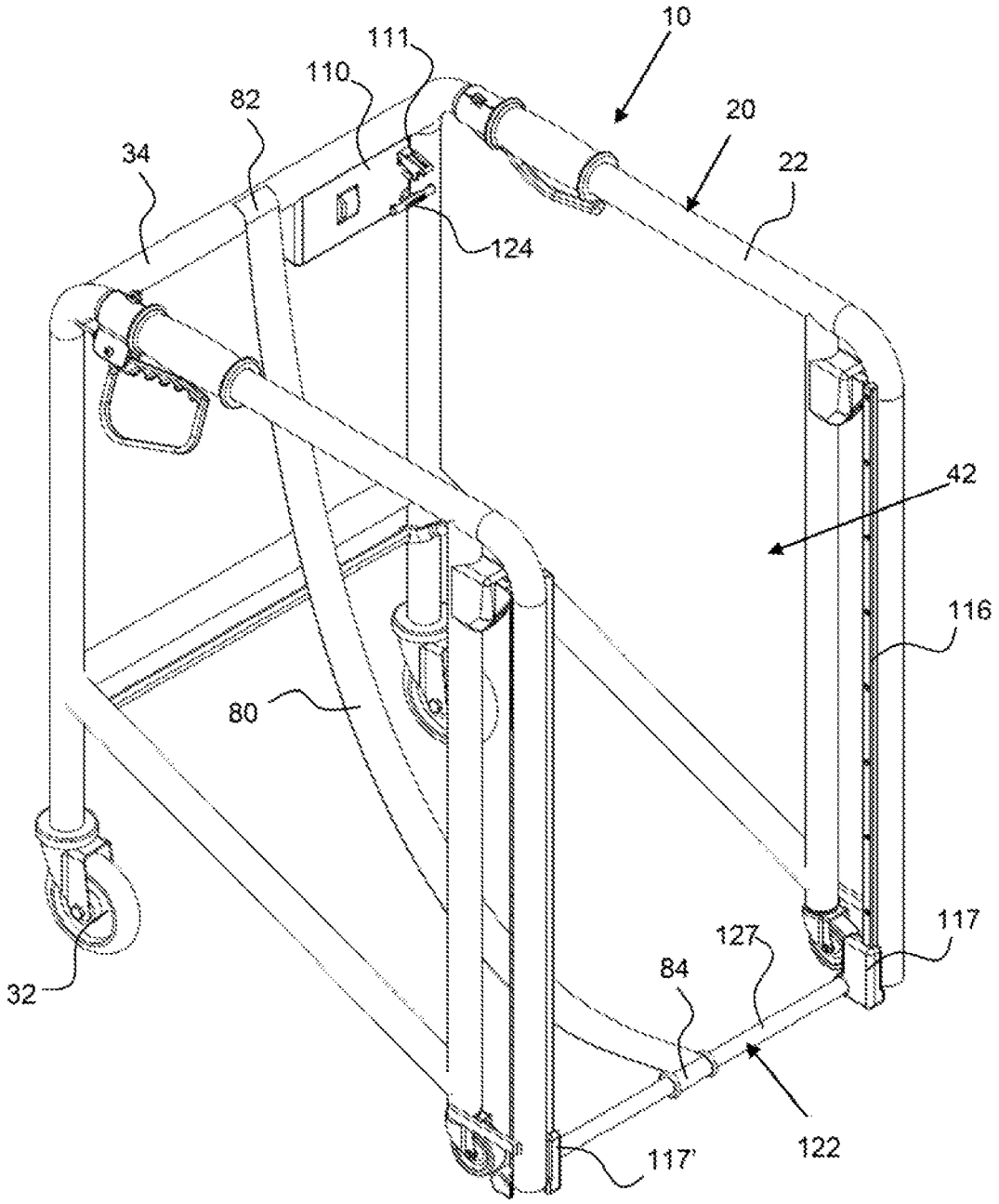
FIG. 15 shows a perspective view of an exemplary safety walker with motorized actuator system that raises and lowers a strap-bar by cables that extend from an actuator interface.
Figure 16:
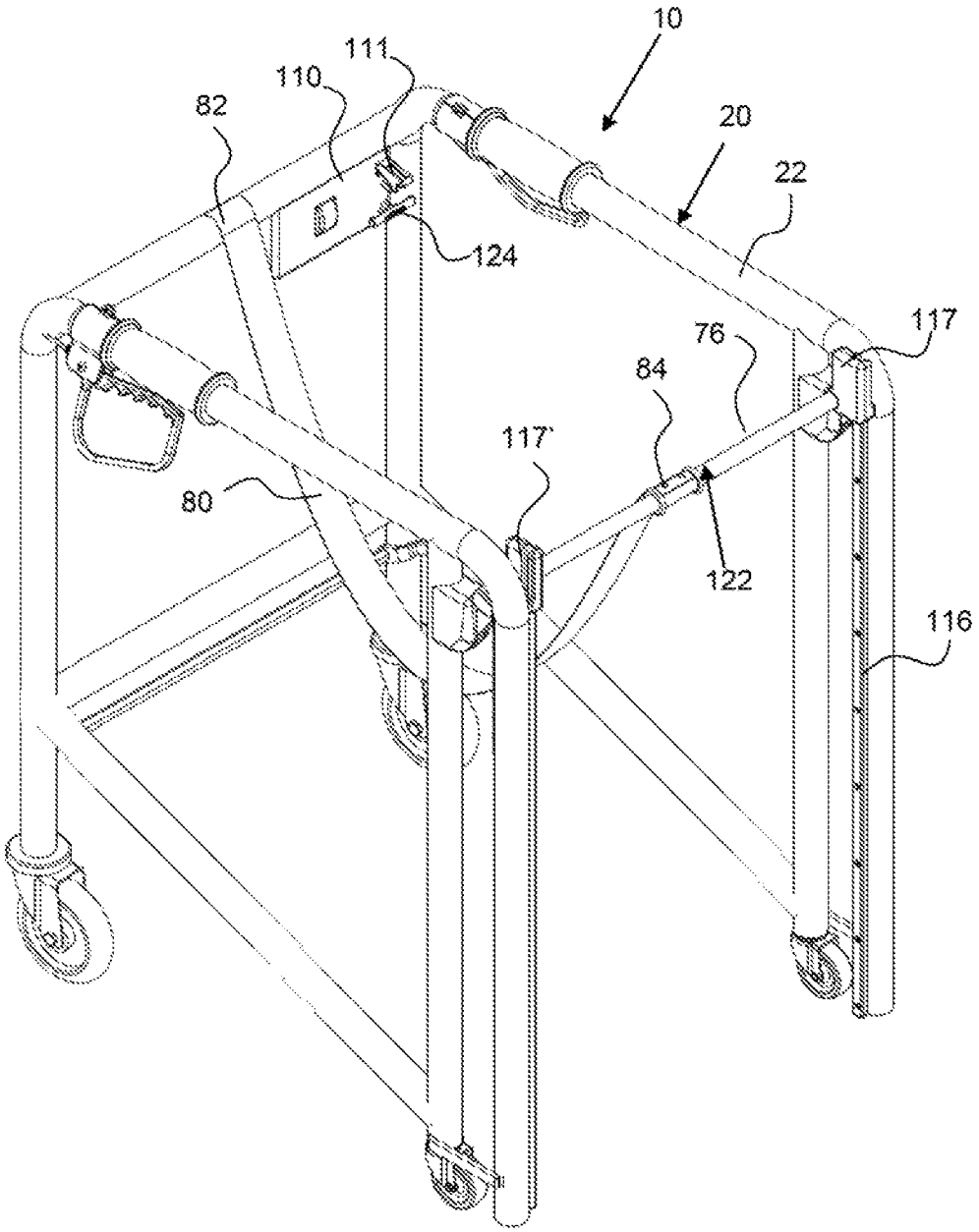
FIG. 16 shows the exemplary safety walker shown in FIG. 15 with the strap-bar in an up position.
Figure 17:
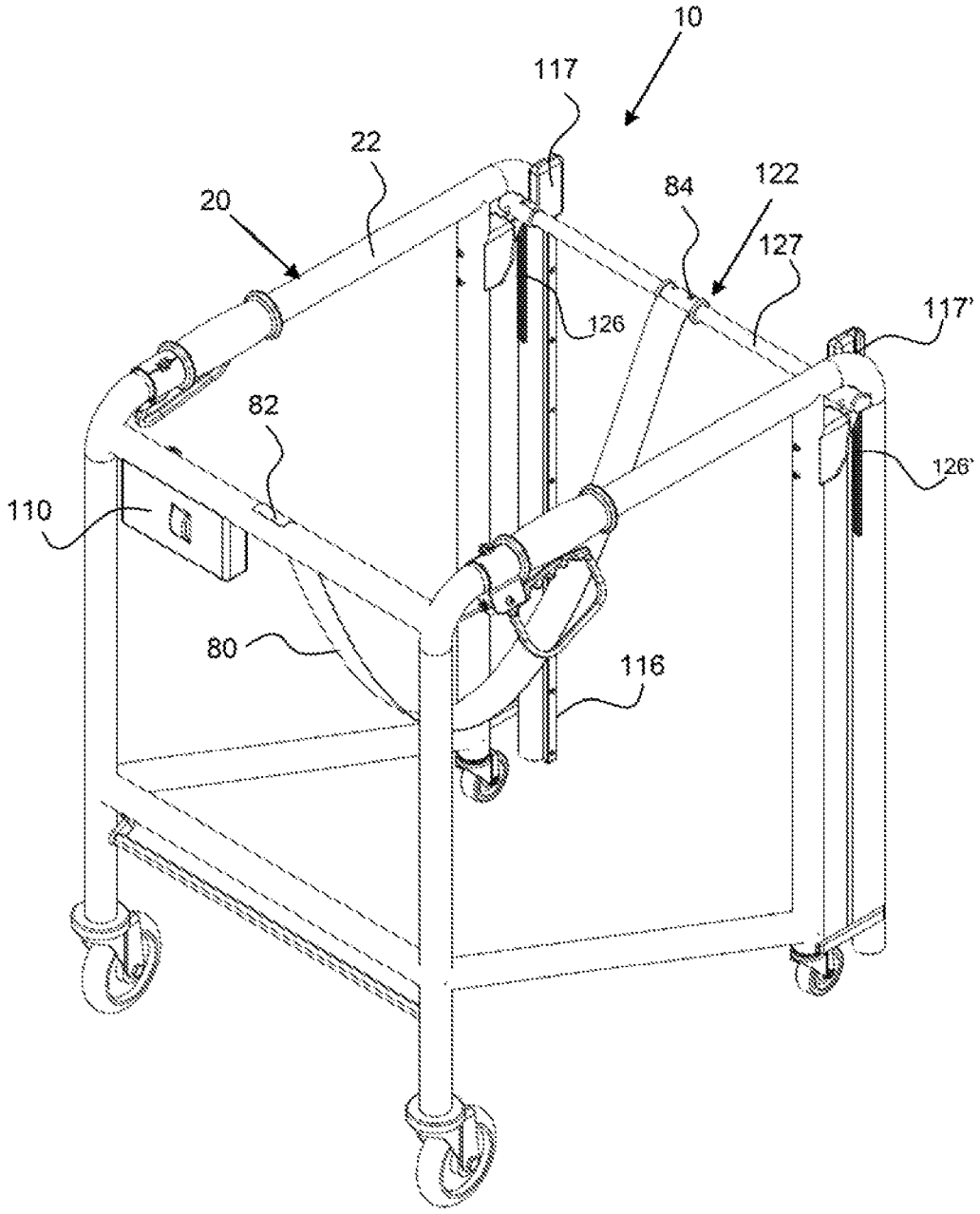
FIG. 17 shows a front perspective view of the exemplary safety walker shown in FIG. 16, with the strap-bar in an up position.
Figure 18:
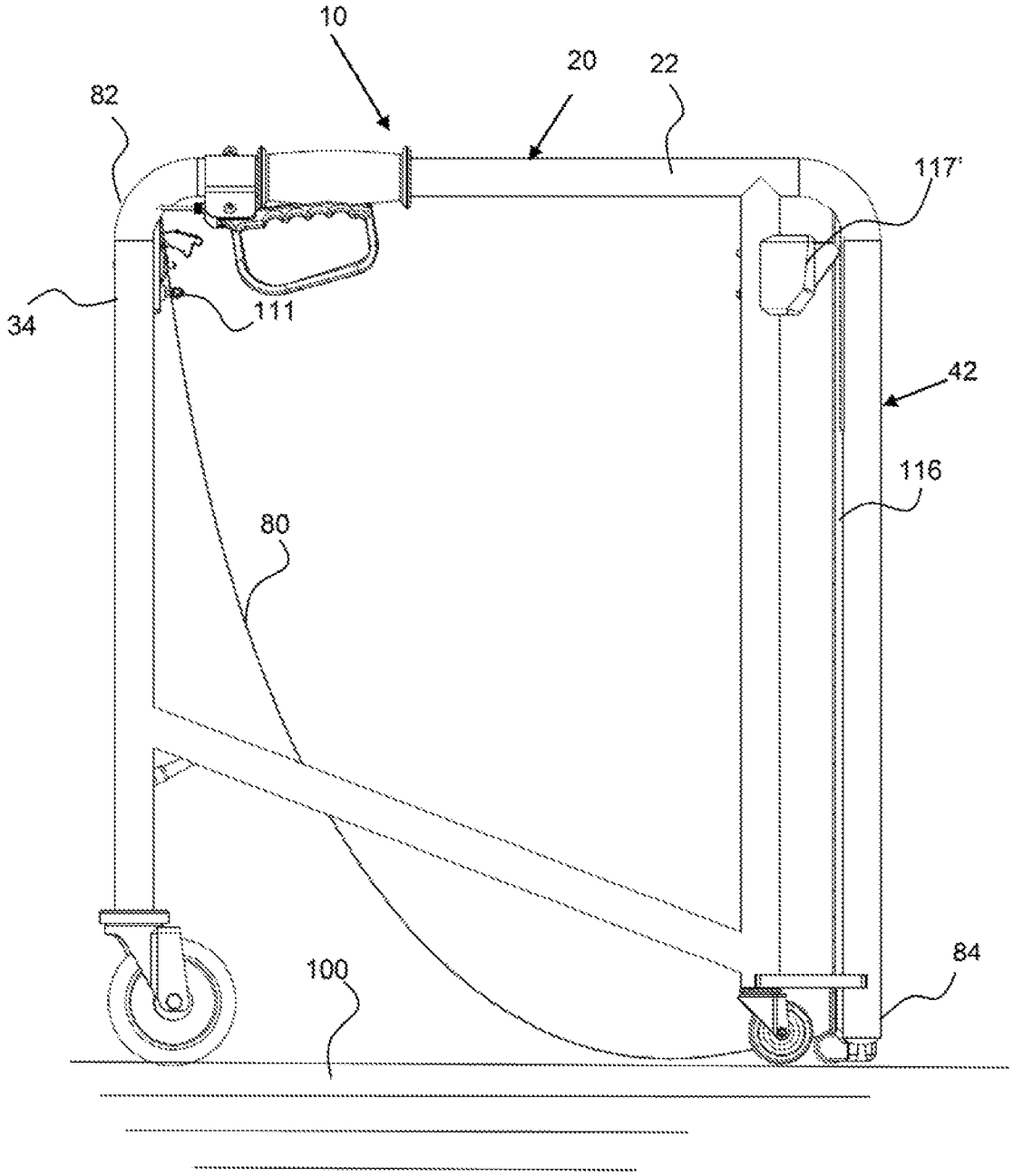
FIG. 18 shows a side view of the exemplary safety walker shown in FIG. 15, with the strap-bar in a down or entry position.
Figure 19:
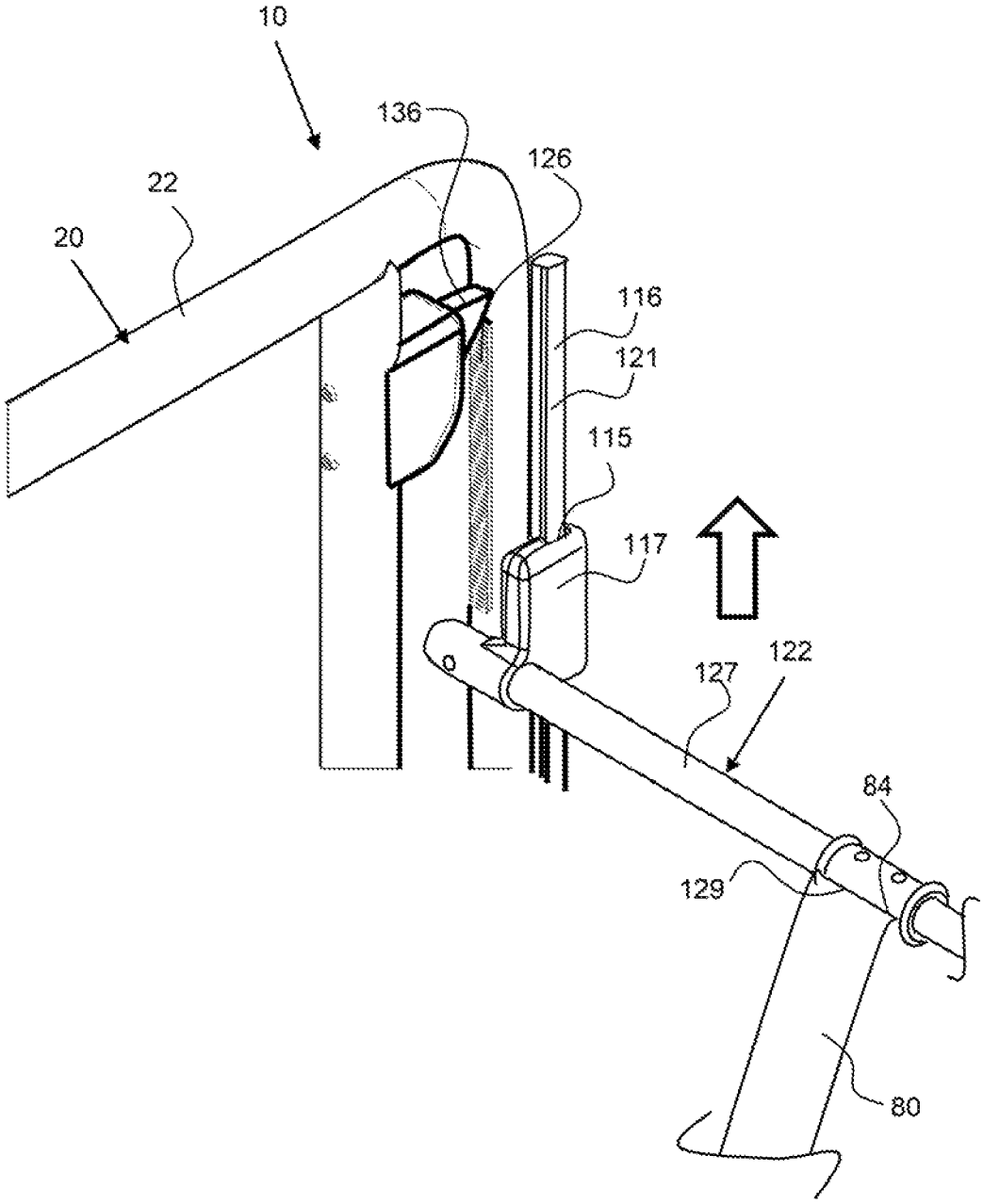
FIG. 19 shows a portion of the exemplary motorized actuator system shown in FIG. 15, with the strap-bar in an intermediate position proximal and secure position with the strap still having slack.
Figure 20:
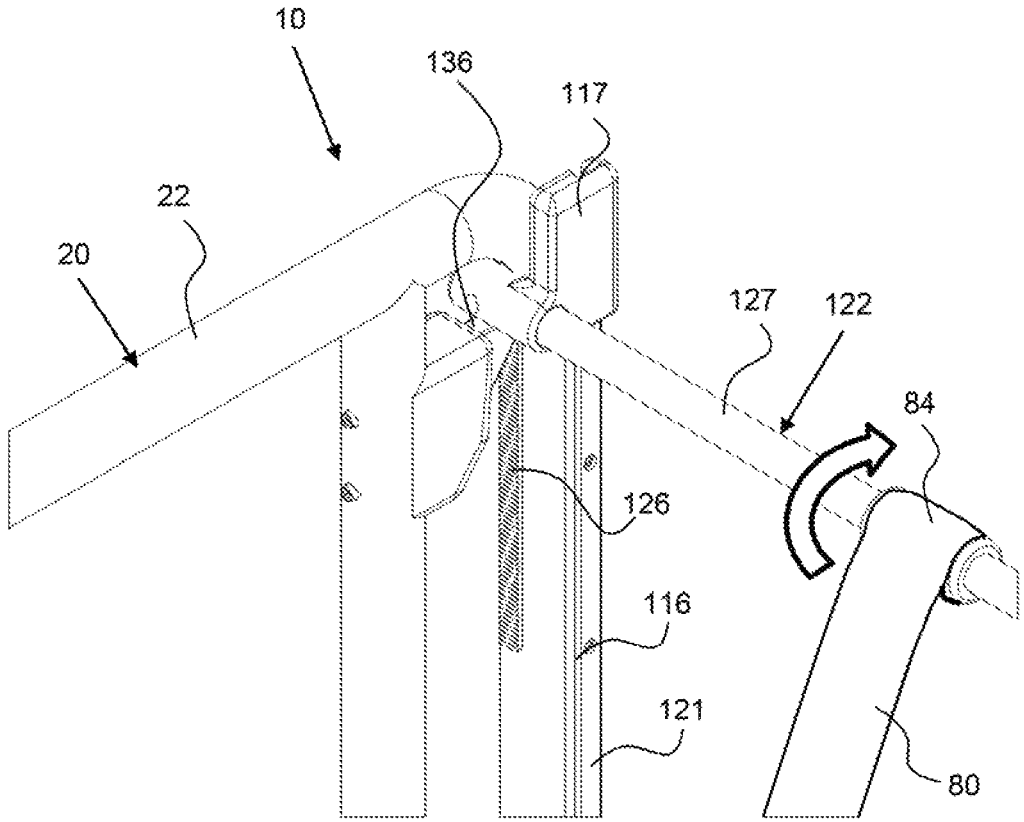
FIG. 20 shows a portion of the exemplary motorized actuator system shown in FIG. 15, with the strap-bar in an up position and the strap wound around the strap-bar to take up slack in the strap.
Figure 21:
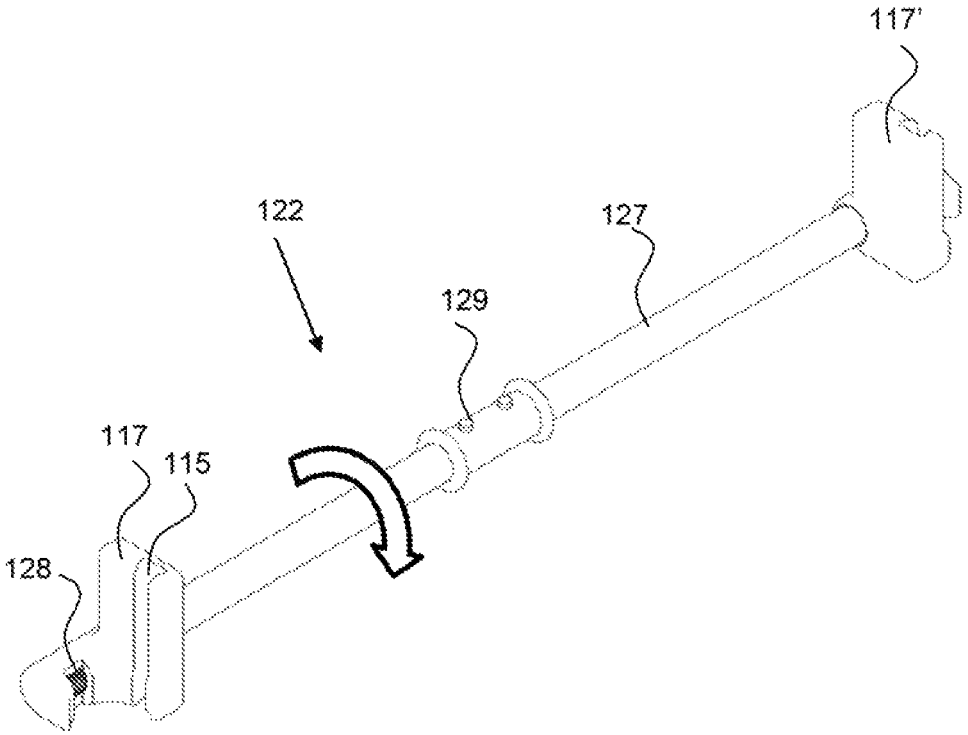
FIG. 21 shows a perspective view of an exemplary strap-bar.
Figure 22:
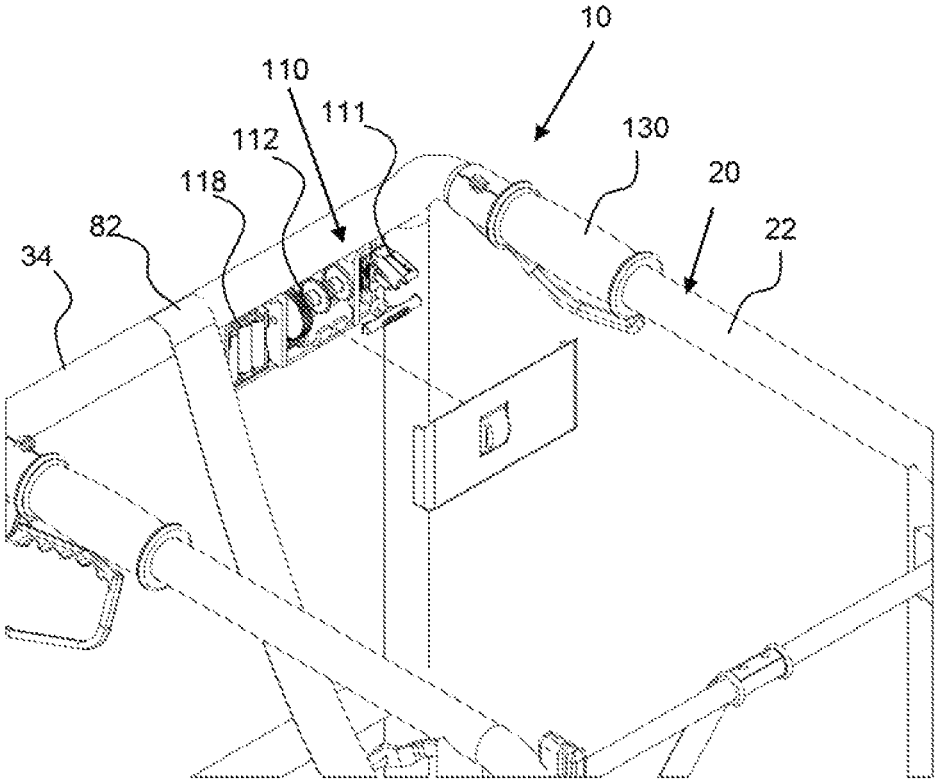
FIG. 22 shows a perspective view of the exemplary safety walker shown in FIG. 15 with the cover to the actuator interface removed.
Figure 23:
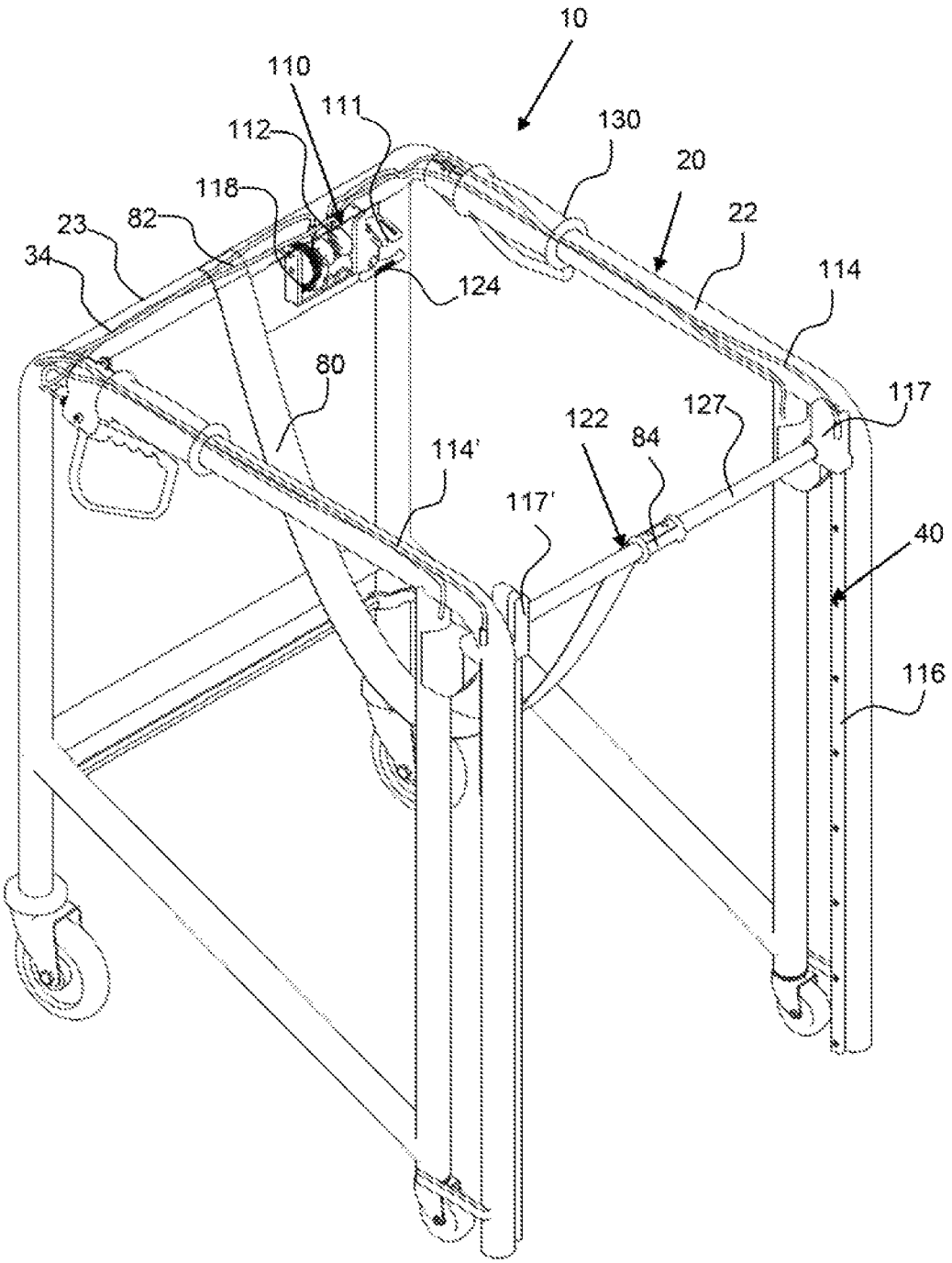
FIG. 23 shows a perspective view of the exemplary safety walker shown in FIG. 15, with the cables shown extending at least partially through the moveable support frame.

Referring now to FIGS. 15 to 23, an exemplary safety walker 10 comprises an actuator system 110 that is motorized to raise and lower a strap-bar 127 by cables that extend from an actuator or user interface 111. The strap-bar 127 has railing couplers 117, 117' that couple the strap-bar to an actuator rail 116. The strap-bar is lifted by cables that are driven by an actuator motor 112. As shown in FIG. 15, the strap-bar is in a down or entry position, with the strap-bar proximal to or resting on the floor. A user simple enters through the back-end opening 42 and then activates the strap-bar by interfacing with user interface 111 that may have an "Up" button or lever, for example. The motor 112, shown in FIGS. 22 and 23 the drives cables 114, shown in FIG. 22 to lift the strap-bar to an up or secure position. The motor may be an electric motor that has a power supply 118, such as batteries, or preferably rechargeable batteries. A portion of the strap-bar assembly 122 is configured to couple with the rails to retain the strap-bar assembly in place and to guide it up and down along the rail. A portion of the strap-bar assembly, such as the rail couplers or the strap-bar itself, may have a slot for riding along a protrusion of the rail, or may have a protrusion for extending into a slot that runs along the rail. As shown in FIG. 21, the rail couplers 117 have a slot 115, a dove-tail shaped recess, for guiding the strap-bar assembly 122 up along the protrusion 121, a dove-tail shaped protrusion, of the actuator rail, as shown in FIG. 20. The strap bar 127 is configured to rotate or spin and has strap-bar teeth 128, as shown in FIG. 20 for engagement with the rail teeth 126 that spin the strap-bar to take up slack in the strap 80. As shown in FIG. 19, the strap-bar assembly 122 is in the process of being lifted up, as indicated by the large arrow. The strap-bar assembly is just below the rail teeth 126 and is being guided along the actuator rail 116 by the rail coupling slot 115 in the rail coupling 117. When the strap-bar teeth engage with the rail teeth 126, the strap-bar 127 will spin and thereby wrap the strap 80 around the strap attachment portion 129 of the strap-bar, as shown in FIG. 20. The strap 80 is wrapped around the strap-bar in FIG. 20 as the strap-bar has rotated up to the secure position. The strap-bar latch 136 is now holding the strap-bar in the sup and secure position. A user may release the strap-bar latch 136 by pulling the strap-bar release 124, as shown in FIG. 23. As shown in FIG. 23, the cables 114 may extend along the interior of the movable support frame 20, such as along the front rail 23 and the hand rails 22 on the left and right side of the safety walker 10. The cables may extend out of the frame and couple with the strap-bar assembly 122, such as to the rail coupling 117, 117'. The support frame has a handle 130 configured thereon.

Figure 24:
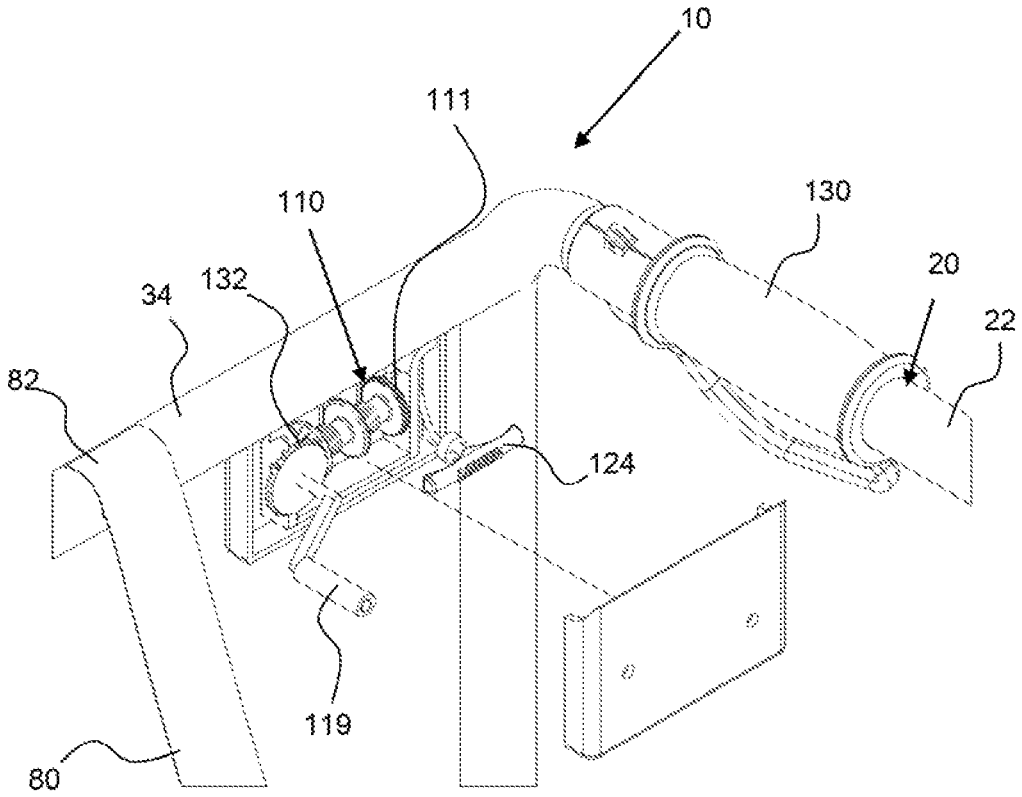
FIG. 24 shows a perspective view of an exemplary safety walker with hand operable actuator system comprising a crank to raise and lower the strap-bar.

As shown in FIG. 24, an exemplary safety walker 10 has a hand operable actuator system 110 comprising a crank 119 to raise and lower the strap-bar. The mechanism of the strap-bar assembly may be the same as that shown and described in FIGS. 15 to 23. The crank may be coupled with one or more gears 132 and these gears may take up a cable 114 to pull the strap-bar up.

Figure 25:
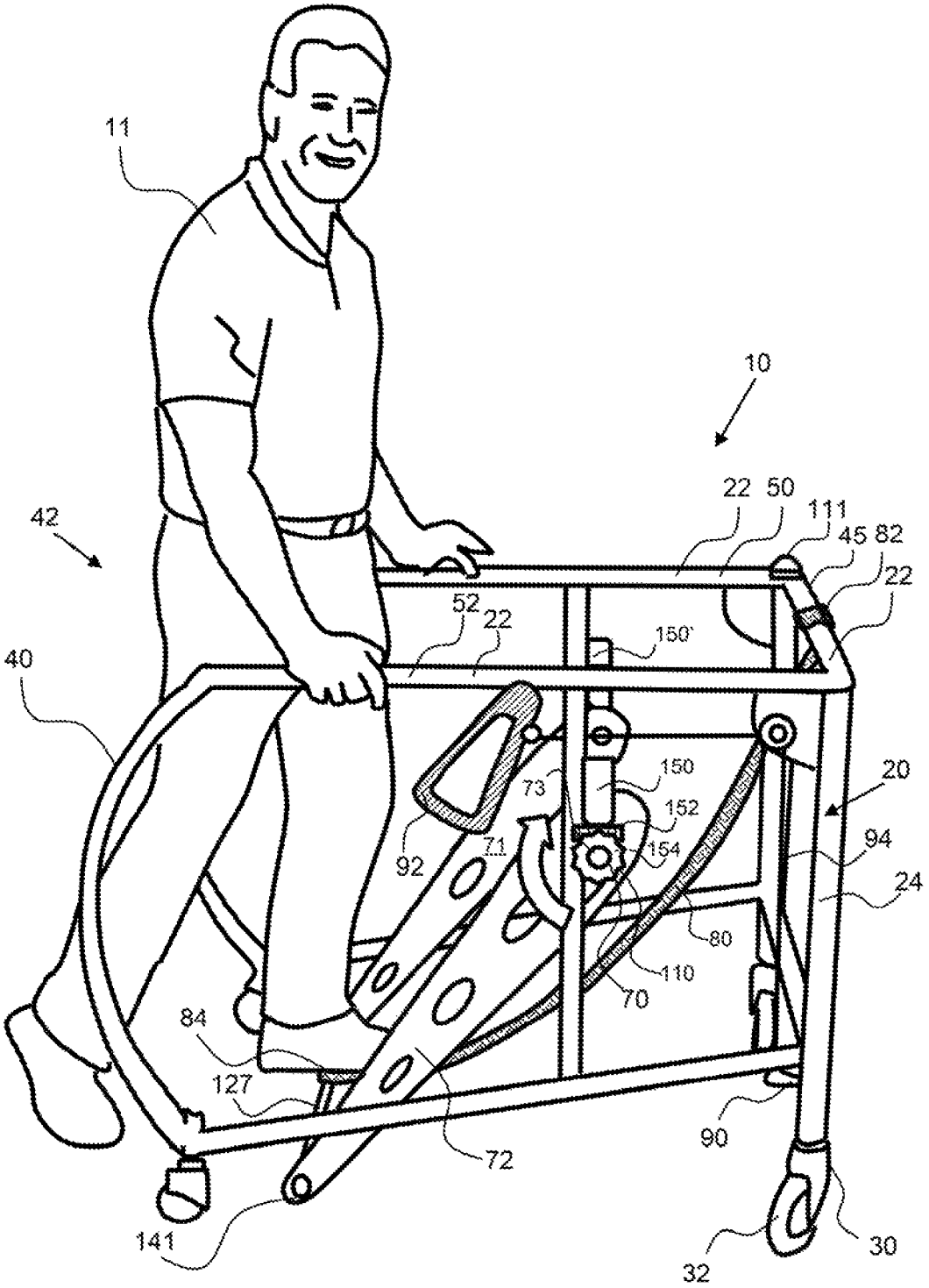
FIG. 25 shows a side view of an exemplary safety walker with motorized actuator system coupled to a pivoting strap mechanism with the strap in a down position.
Figure 26:
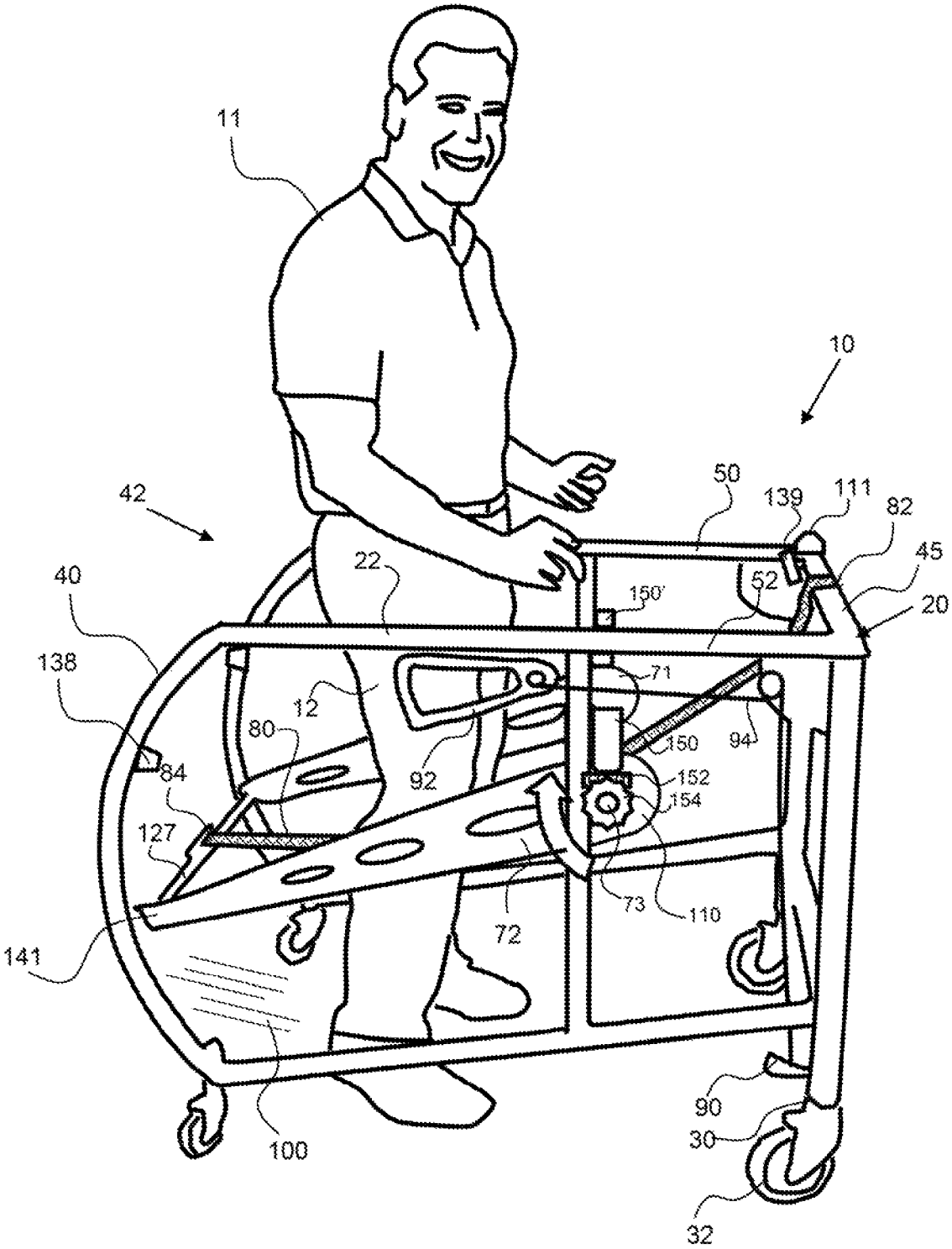
FIG. 26 shows a side view of the exemplary safety walker shown in FIG. 25, with the strap in a partially up position.

As shown in FIGS. 25 and 26, an exemplary safety walker 10 is configured with a motorized actuator system 110 coupled to a pivoting strap mechanism 70. The actuator system 110 comprises a motor 150 attached to the movable frame 20 and having a worm gear 152 that drives a drive gear 154 attached to the strap actuator 72. The left and right strap actuators 71, 72, or first and second strap actuators, rotate about a pivot 73 and have an extended entry end 141 that lifts the strap-bar 127 coupled therebetween up to a secure position, as described herein. A user interface 111 may enable a person to step into the safety walker and press the button or actuate a lever to activate the motor to spin the worm gear 152, which in turn spins the drive gear 154 to rotate the strap actuators 71, 72, the strap-bar 127 and raise the actuating end 84 of the strap 80. As shown in FIG. 25, the strap 80 is in an entry position and is proximal the floor. As shown in FIG. 26, the strap 80 is elevated up as the motor rotates or pivots the strap actuators 72, 71 up. It is to be understood that a single motorized assembly may be configured on the safety walker to drive the strap up and down, as the strap actuators are coupled by the strap-bar 127 that would enable a motorized assembly on one side to drive the pivoting strap mechanism. In an exemplary embodiment, as shown, the safety walker comprises two motorized drive assemblies, one on the left side to drive the left strap actuator and one on the right side to drive the right strap actuator. The user interface may have a physical wire that extends to the motor or may send a wireless signal. The user may simply press a separate button on the user interface to lower the strap actuator by driving the motor in an opposing direction to the direction of rotation to raise the strap, or a strap actuator latch 138 may have a release 139 allow the strap actuators to pivot back down.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What claimed is:

1. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a strap actuator system comprising:

i) a safety strap having a length from a fixed end to an actuating end;

ii) a strap-bar that extends across the back-end opening of the movable support frame and is configured to move up to raise the actuating end of the safety strap;

wherein the fixed end of the strap is attached to the front end of the moveable support frame and the actuating end is attached to the strap-bar;

iii) an actuator coupled with the strap-bar and configured to raise the strap-bar from an entry position to an elevated secure position;

wherein in said entry position the strap-bar is configured proximal to a floor;

wherein in said secure position the strap-bar and actuating end of the strap are elevated up from the said floor.

2. The safety walker of claim 1, wherein the actuator comprises a crank.

3. The safety walker of claim 1, wherein the actuator comprises an electric motor.

4. The safety walker of claim 3, wherein the strap-bar is coupled to actuator rails that are attached to the left and right side of the movable support frame, proximal the back end, and extend substantially vertically to guide the strap-bar from said entry position to said secure position.

5. The safety walker of claim 4, wherein the strap-bar comprises rail couplings proximal to either end of the strap-bar for coupling with the actuator rails.

6. The safety walker of claim 5, wherein the strap-bar comprises a gear, and wherein the actuator rail comprises rail teeth, wherein the gear of the strap-bar engages with the rail teeth to rotate the strap-bar as it is lifted up along the actuator rail.

7. The safety walker of claim 6, wherein the rail teeth extend, from a location proximal a top of the rail, down only a portion of a length of the rail.

8. The safety walker of claim 4, further comprising:

a) a latch that locks the strap-bar in an elevated and secure position; and b) a strap-bar release that is coupled with the latch and configured to release the latch.

9. The safety walker of claim 3, further comprising a user interface for controlling the actuator system and controlling moving of the strap-bar from an entry position to an elevated secure position.

10. The safety walker of claim 3, wherein the motor is coupled to the strap-bar by cables, wherein the motor pulls the cables to lift the strap-bar.

11. The safety walker of claim 10, wherein the cables extend through the movable support frame at least a portion of a distance from the motor to the strap-bar.

12. The safety walker of claim 3, wherein the motor is coupled with a first strap actuator that extends along the left side or the right side of the movable support frame and comprising;

an entry end that is configured to move up and down and wherein the strap-bar is coupled to the first strap actuator proximal the entry end of the first strap actuator;

a pivot;

wherein the motor is attached to the movable support frame and configured to rotate the first strap actuator about said pivot.

13. The safety walker of claim 12, wherein the motor is directly coupled to the first strap actuator to rotate the strap actuator about the pivot.

14. The safety walker of claim 12, wherein the motor rotates a worm gear that engages with a drive gear that is coupled to the first strap actuator at the pivot, whereby rotation of the worm gear rotates the drive gear to pivot the entry end of the first strap actuator up to a secure position.

15. The safety walker of claim 12, further comprising a user interface for controlling the actuator system and controlling moving of the strap-bar from an entry position to an elevated secure position.

16. The safety walker of claim 12, wherein the motor is coupled to the strap-bar by cables, wherein the motor pulls the cables to rotate the first strap actuator about the pivot.

17. The safety walker of claims 12, further comprising a second strap actuator that extends along an opposing side of the movable support frame from said first strap actuator and comprising:

an entry end that is configured to move up and down and wherein the strap-bar is coupled to the second strap actuator proximal the entry end of the second strap actuator;

a pivot;

wherein the strap-bar extends between and is attached to the first and second strap actuators proximal entry ends of the strap actuators.

18. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a strap actuator system comprising:

i) a safety strap having a length from a fixed end to an actuating end;

ii) a strap-bar that extends across the back-end opening of the movable support frame and is configured to move up to raise the actuating end of the safety strap;

iii) actuator rails that are attached to the left and right side of the movable support frame, proximal the back end, and extend substantially vertically to guide the strap-bar from said entry position to said secure position;

wherein the fixed end of the strap is attached to the front end of the moveable support frame and the actuating end is attached to the strap-bar;

iv) an electric motor coupled with the strap-bar and configured to raise the strap-bar from an entry position to an elevated secure position;

v) a user interface for controlling the actuator system and controlling moving of the strap-bar from an entry position to an elevated secure position, wherein in said entry position the strap-bar is configured proximal to a floor;

wherein in said secure position the strap-bar and actuating end of the strap are elevated up from said floor and thereby raises the actuating end of the safety strap.

19. The safety walker of claim 18, wherein the motor is coupled to the strap-bar by cables, wherein the motor pulls the cables to lift the strap-bar.

20. The safety walker of claim 18, wherein the strap-bar comprises rail couplings proximal to either end of the strap-bar for coupling with the actuator rails.

21. The safety walker of claim 18, wherein the strap-bar comprises a gear, and wherein the actuator rail comprises rail teeth, wherein the gear of the strap-bar engages with the rail teeth to rotate the strap-bar as it is lifted up along the actuator rail.

22. The safety walker of claim 18, wherein the rail teeth extend, from a position proximal a top of the rail, down only a portion of a length of the rail.

23. The safety walker of claim 18, further comprising:

a) a latch that locks the strap-bar in an elevated and secure position; and b) a strap-bar release that is coupled with the latch and configured to release the latch.

24. A safety walker comprising:

a) a movable support frame comprising:

i) a base having a plurality of wheels;

ii) a front end having a front support;

iii) a back end having an opening for entry into the movable support frame;

iv) a left side having a left side support having an attached end to the front support, and an extended end;

v) a right side having a right side support having an attached end to the front support, and an extended end;

wherein the left and right side supports extend back from the front support and wherein the extended ends of the left and right supports form said opening for entry into the movable support frame;

b) a strap actuator system comprising:

i) a safety strap having a length from a fixed end to an actuating end;

ii) a first strap actuator that extends along the left side of the movable support frame;

iii) a second strap actuator that extends along the right side of the movable support frame;

wherein each of the first and second strap actuators comprise an entry end that is configured to move up and down and a pivot;

wherein the first and second strap actuators rotate about their respective pivot;

wherein the first and second strap actuators extend substantially in parallel with each other;

iv) a strap-bar that extends between and is attached to the first and second strap actuators proximal to the entry ends;

wherein the fixed end of the strap is attached to the front end of the movable support frame and the actuating end is attached to the strap-bar;

wherein the first and second strap actuators rotate about the pivot to raise the entry end of the strap actuators, the strap-bar attached thereto and the actuating end of the safety strap;

v) an electric motor coupled with the first or second strap actuators and configured to rotate the first and second strap actuators about the pivot;

vi) a user interface for controlling the strap actuator system and controlling moving rotation of the first and second strap actuators about said pivots to raise the strap-bar from an entry position to an elevated secure position, wherein in said entry position the strap-bar is configured proximal to floor; and wherein in said secure position the entry end of the strap actuator is elevated up from said floor and thereby raises the actuating end of the safety strap.

25. The safety walker of claim 24, wherein the electric motor is directly coupled to the strap actuator to rotate the strap actuator about the pivot.

26. The safety walker of claim 24, wherein the motor rotates a worm gear that engages with a drive gear that is coupled to strap actuator at the pivot, whereby rotation of the worm gear rotates the drive gear to pivot the entry end of the strap actuator up to a secure position.

27. The safety walker of claim 24, comprising a first electric motor coupled to the fir strap actuator and a second electric motor coupled to the second strap actuator.

28. The safety walker of claim 24, further comprising:

a) a latch that locks the strap-bar in an elevated and secure position; and b) a strap-bar release that is coupled with the latch and configured to release the latch.

29. The safety walker of claim 24, wherein the motor is coupled to the strap-bar by cables, wherein the motor pulls the cables to rotate the first strap actuator about the pivot.

30. The safety walker of claim 29, wherein the cables extend through the movable support frame at least a portion of a distance from the motor to the first or second strap actuator or strap-bar.

* * * * *